US008059485B2

(12) United States Patent
Sato

(10) Patent No.: US 8,059,485 B2
(45) Date of Patent: Nov. 15, 2011

(54) COMMUNICATION SYSTEM, INFORMATION COLLECTING METHOD AND BASE STATION APPARATUS

(75) Inventor: Takeshi Sato, Tokyo (JP)

(73) Assignee: NEC Corporation, Tokyo (JP)

( * ) Notice: Subject to any disclaimer, the term of this patent is extended or adjusted under 35 U.S.C. 154(b) by 361 days.

(21) Appl. No.: 12/132,899

(22) Filed: Jun. 4, 2008

(65) Prior Publication Data

US 2009/0316522 A1 Dec. 24, 2009

(30) Foreign Application Priority Data

Jun. 7, 2007 (JP) ..... 2007-151428

(51) Int. Cl.
*H04B 1/59* (2006.01)
*H04B 11/00* (2006.01)

(52) U.S. Cl. ..... 367/5; 367/3; 367/134

(58) Field of Classification Search ..... 367/3, 5, 367/134

See application file for complete search history.

(56) References Cited

U.S. PATENT DOCUMENTS 3,230,500 A * 1/1966 Dunn ..... 367/3
3,987,404 A * 10/1976 Woodruff ..... 367/3
4,203,160 A * 5/1980 Doherty ..... 367/134
4,315,324 A * 2/1982 Junod et al. ..... 367/3
4,323,988 A * 4/1982 Will et al. ..... 367/4
4,531,235 A * 7/1985 Brusen ..... 455/273
4,590,590 A * 5/1986 Toone et al. ..... 367/4
5,452,262 A * 9/1995 Hagerty ..... 367/134
5,579,285 A * 11/1996 Hubert ..... 367/133
6,058,071 A * 5/2000 Woodall et al. ..... 367/134
6,711,095 B1 * 3/2004 Daniels ..... 367/134
7,016,260 B2 * 3/2006 Bary ..... 367/15
7,496,000 B2 * 2/2009 Vosburgh et al. ..... 367/134
2004/0022215 A1 * 2/2004 Okuhata et al. ..... 370/334
2009/0067289 A1 * 3/2009 Lee et al. ..... 367/134

FOREIGN PATENT DOCUMENTS

JP 2003077087 A 3/2003

OTHER PUBLICATIONS

James K. Thompson et al., "A Simulation of an Acoustic Data Link Between Underwater Transducers and a Moored Buoy", IEEE, 1982, pp. 223-227.

* cited by examiner

*Primary Examiner* — Ian Lobo

(57) ABSTRACT

A communication system for obtaining predetermined information from an underwater terminal via a sonobuoy is provided. The system includes an underwater terminal for transmitting and receiving sound wave signals, a base station apparatus for transmitting and receiving radio wave signals, and a plurality of sonobuoys for transmitting and receiving the sound wave signals to and from the underwater terminal, and for transmitting and receiving the radio wave signals to and from the base station apparatus.

20 Claims, 11 Drawing Sheets

COMMUNICATION SYSTEM, INFORMATION COLLECTING METHOD AND BASE STATION APPARATUS

This application is based upon and claims the benefit of priority from Japanese Patent Application No. JP 2007-151428, filed on Jun. 7, 2007, the disclosure of which is incorporated herein in its entirety by reference.

TECHNICAL FIELD

The present invention relates to a communication system, an information collecting method and a base station apparatus and in particular, relates to a communication system in which a base station apparatus and an underwater terminal communicate with each other via a sonobuoy, an information collecting method in the communication system and a base station apparatus used in the same.

BACKGROUND ART

A type of a communication system that a base station apparatus communicates with an underwater terminal via a sonobuoy is known. The base station apparatus is installed in flight vehicles moving in the air such as airplanes or helicopters, inside a building on land or in a vessel on the water. The underwater terminal is installed in an underwater movable body such as a submarine or installed on the bottom of the sea. The sonobuoy is installed on the water surface. The sonobuoy is a buoy having a sonar device. The sonobuoy communicates with the base station apparatus using a radio wave and communicates with the underwater terminal using a sound wave to relay communication between the base station apparatus and the underwater terminal.

Japanese Patent Application Laid-Open No. 2003-77087A discloses a technology related to the communication system.

This document discloses a system in which an apparatus arranged on the sea processes data on water temperature and water depth which are measured in water. As shown in FIG. 11, the system includes an underwater measuring unit 43, a buoy unit 44 and a signal processor 45.

The underwater measuring unit 43 is connected with the branched rope 47 in water. A main line 46 is arranged in water in parallel to the sea surface. One end of the branched rope 47 is tied to the main line 46 and the other end thereof is directed toward the bottom of the sea. The underwater measuring unit 43 measures water temperature and water depth, and transmits measured data to the buoy unit 44 using ultrasonic waves. The buoy unit 44 floating on the sea receives the data on the water temperature and the water depth from the underwater measuring unit 43 and transmits the data to the signal processor 45 using radio waves. The signal processor 45 installed in a vessel 48 receives the data on the water temperature and the water depth from the buoy unit 44 through radio waves and processes the data. As mentioned above, the underwater measuring unit 43 sends the data on the water temperature and the water depth to the signal processor 45 via one buoy unit 44. Here, the underwater measuring unit 43, the buoy unit 44 and the signal processor 45 correspond to the underwater terminal, the sonobuoy and the base station apparatus respectively.

And other technology related to the above-mentioned communication system is also disclosed in a document ("A SIMULATION AN ACOUSTIC DATA LINK BETWEEN UNDERWATER TRANSDUCER AND MOORED BUOY", James K. Thompson and Koorosh Naghshineh, Department of Mechanical Engineering, Louisiana State University, Baton Rouge, La. 70803). In the technology disclosed by the document, as written in a summary thereof, a computer simulation of acoustic data transmission between underwater transducers and a buoy is being developed in a project sponsored by the NOAA (National Oceanic and Atmospheric Administration) Data Buoy office. In the document, a communication with underwater transducers is performed using only one buoy. Here, the underwater transducer and the buoy correspond to the underwater terminal and the sonobuoy respectively.

Moreover, FIG. 10 shows a related communication system in which one sonobuoy 41 relays communication between an underwater terminal 40 installed in a movable body in water and a base station apparatus 42 installed in a flying vehicle in the air. The system includes the underwater terminal 40 installed in the movable body such as a submarine and a submersible research vehicle, the sonobuoy 41 arranged on the water surface and the base station apparatus 42 installed in the flight vehicle which moves in the air. The sonobuoy 41 communicates with the base station apparatus 42 using radio waves and communicates with the underwater terminals 40 using sound waves to relay communication between the base station apparatus 42 and the underwater terminal 40. The underwater terminal 40 carried in the movable body transmits a control signal including SOS as sound wave signals, when the movable body wrecks. In order to discover the wrecked movable body and obtain information therefrom, one sonobuoy 41 is thrown from vessel or the like in a sea area where the movable body is likely to exist.

Detecting the control signal from the underwater terminal 40, the sonobuoy 41 informs the base station apparatus 42 of detecting of the control signal by radio wave signals. Then, the base station apparatus 42 communicates with the underwater terminal 40 via the sonobuoy 41, and receives distress situation including information on underwater environment (such as water temperature, light quantity and sound pressure or the like) from an underwater terminal 40. However, when the sonobuoy 41 does not detect the control signal from the underwater terminal 40 (i.e. the base station apparatus 42 is not informed from the sonobuoy 41 because the control signal is not found) after a predetermined time (e.g. 10 minutes, for example) passes since throwing sonobuoy 41, the sonobuoy is pulled up and is thrown into a different sea area in order to investigate whether or not the sonobuoy 41 detects the control signal from the underwater terminal 40. The process is repeated until the sonobuoy 41 detects the control signal from the underwater terminal 40.

The sonobuoy 41 may fail to receive the control signal because of variation of quality of sound wave communication between the underwater terminal 40 and the sonobuoy 41. The quality of sound wave communication is changeable due to strength of ocean waves, salinity of sea water, sea water temperature and the like. Therefore, in order to look for an optimal sound wave communication path, the operation of trial and error above-mentioned is necessary.

Moreover, in another technology related to the above-mentioned communication system, location of an underwater terminal 40 is already known. For example, the underwater terminal 40 is fixed at a predetermined position on the bottom of the sea. Such system includes the underwater terminal 40 set to the predetermined underwater position in advance, a sonobuoy 41 installed on a surface of the water and a base station apparatus 42 installed in a flight vehicle. In order to relay communication between the base station apparatus 42 and the underwater terminal 40, the sonobuoy 41 communicates with the base station devices 42 using radio waves, and communicates with the underwater terminal 40 by sound waves. The underwater terminal 40 transmits a control signal including a signal which indicates the position thereof as sound wave signals. An operator of the system throws one sonobuoy 41 from a vessel into the sea area where the underwater terminal 40 exists.

Detecting the control signal from the underwater terminal 40, the sonobuoy 41 informs the base station apparatus 42 of detection thereof by radio signals. Then, the base station apparatus 42 communicates with the underwater terminal 40 via the sonobuoy 41, and receives measured underwater environmental information such as water temperature, light quantity and sound pressure from the underwater terminal 40. However, when the sonobuoy 41 does not detect the control signal from the underwater terminal 40 (i.e. the base station apparatus 42 is not informed from the sonobuoy 41 because the control signal is not found) after a predetermined time (e.g. 10 minutes) passes since throwing sonobuoy 41, the sonobuoy 41 is pulled up and is thrown into a different sea area in order to investigate whether or not the sonobuoy 41 detects the control signal from the underwater terminal 40. The operation is repeated until the sonobuoy 41 detects the control signal from the underwater terminal 40. In order to look for an optimal sound wave communication path, the operation of trial-and-error above-mentioned is also necessary in the communication system.

SUMMARY

An exemplary object of the invention is to provide a communication system, an information collecting method and a base station apparatus in which repeating installation operation of a sonobuoy is unnecessary. The communication system of the present invention can also manage emergency such as underwater distress of a movable body quickly. The communication system of the present invention can reduce risks of the communication path disconnection between an underwater terminal and a base station apparatus as compared with the communication system with only one sonobuoy.

In an exemplary aspect of the invention, a communication system for obtaining predetermined information from an underwater terminal via a sonobuoy includes an underwater terminal for transmitting and receiving sound wave signals, a base station apparatus for transmitting and receiving radio wave signals, and a plurality of sonobuoys for transmitting and receiving the sound wave signals to and from the underwater terminal, and for transmitting and receiving the radio wave signals to and from the base station apparatus.

In an exemplary aspect of the invention, an information collecting method from an underwater terminal with a base station apparatus via a sonobuoy, includes: arranging a plurality of sonobuoys in a predetermined water area where the underwater terminal is located; transmitting sound wave signals from the underwater terminal; detecting the sound wave signals with the plurality of sonobuoys; calculating quality of the sound wave signal in at least one of the plurality of sonobuoys which is capable of detecting the sound wave signals; transmitting radio wave signals including information on the quality of the sound wave signal to the base station apparatus; receiving the radio wave signals and calculating quality of the radio wave signal in the base station apparatus; selecting any sonobuoy with high communication quality in the plurality of sonobuoys based on both the quality of the sound wave signal and the quality of the radio wave signal in the base station apparatus; and obtaining a predetermined information from the underwater terminal via the sonobuoy with high communication quality in the base station apparatus.

In an exemplary aspect of the invention, a base station apparatus for obtaining predetermined information from an underwater terminal via a plurality of sonobuoys, each the sonobuoy communicating with the underwater terminal using sound wave signals and communicating with the base station apparatus using radio wave signals, wherein the base station apparatus is provided with a function for selecting any sonobuoy communicating using quality sound wave signal and quality radio wave signal and for obtaining the predetermined information from the underwater terminal via the selected sonobuoy.

BRIEF DESCRIPTION OF THE DRAWINGS

Exemplary features and advantages of the present invention will become apparent from the following detailed description when taken with the accompanying drawings in which.

EXEMPLARY EMBODIMENT

Exemplary embodiments of the present invention will now be described in detail in accordance with the accompanying drawings.

Next, a first exemplary embodiment of the communication system of the present invention will be described with reference to FIG. 1 and FIG. 2.

Figure 1:
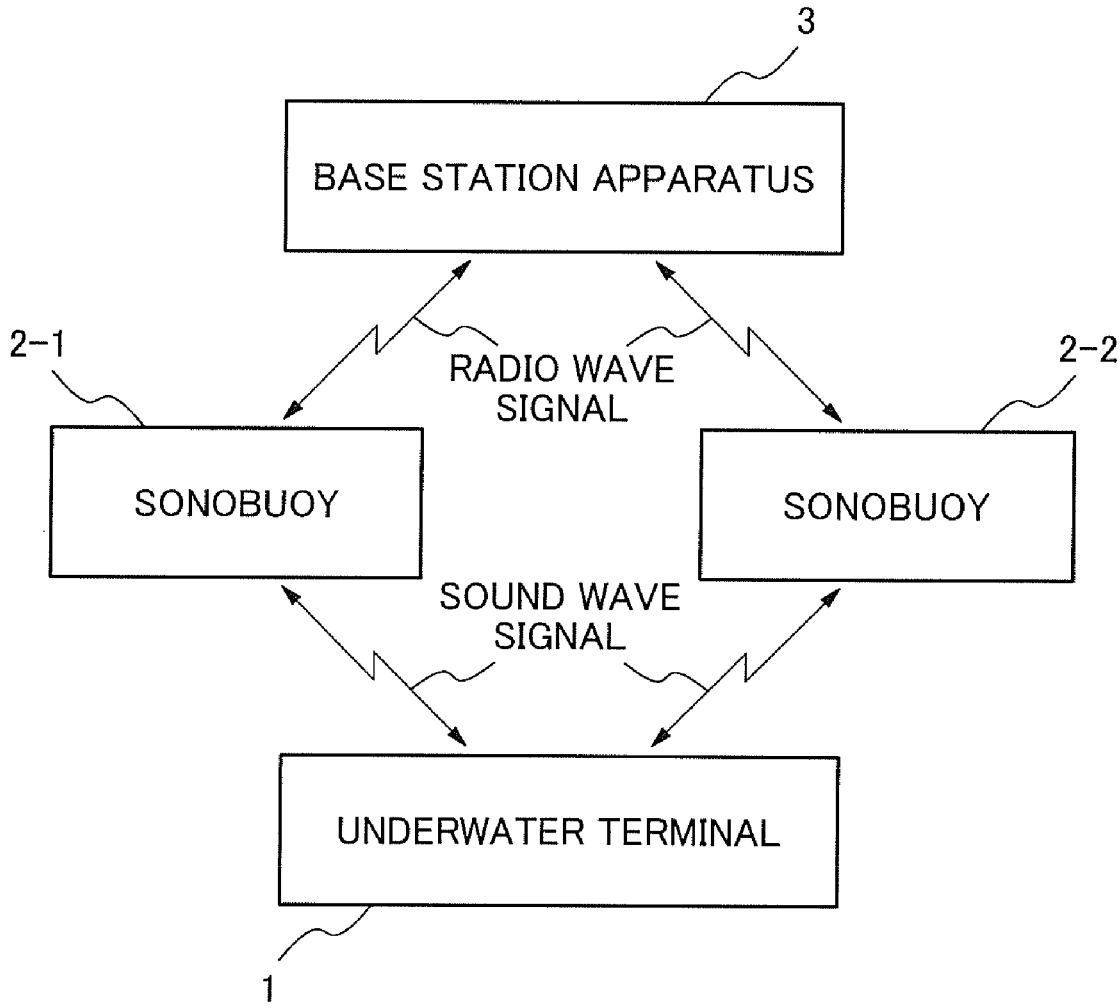
FIG. 1 is a drawing showing a first exemplary embodiment of a communication system of the present invention.

FIG. 1 shows the first exemplary embodiment of the communication system of the present invention.

The communication system of exemplary embodiment of the present invention shown in FIG. 1 includes an underwater terminal 1 installed in water, a plurality of sonobuoys 2-1 or 2-2 installed on the water surface and a base station apparatus 3 installed on land, in the air or on a vessel. Two sonobuoys are used in the communication system in FIG. 1. More than two sonobuoys are also available. Each of the sonobuoys 2-1 and 2-2 transmits and receives radio wave signals to and from the base station apparatus 3 and transmits and receives sound wave signals to and from the underwater terminals 1 to relay communication between the underwater terminal 1 and the base station apparatus 3. The sonobuoys 2-1 and 2-2 include sonobuoy ID to identify each of sonobuoys. When the sonobuoys 2-1 and 2-2 communicate with the base station apparatus 3, the sonobuoy ID information is transmitted with other information as radio wave signals. The underwater terminal 1 is installed in a movable body such as a submarine and a deep sea research vessel, or is fixed on the bottom of sea. The base station apparatus 3 is installed in an airplane, a land control station or the like.

Figure 2:
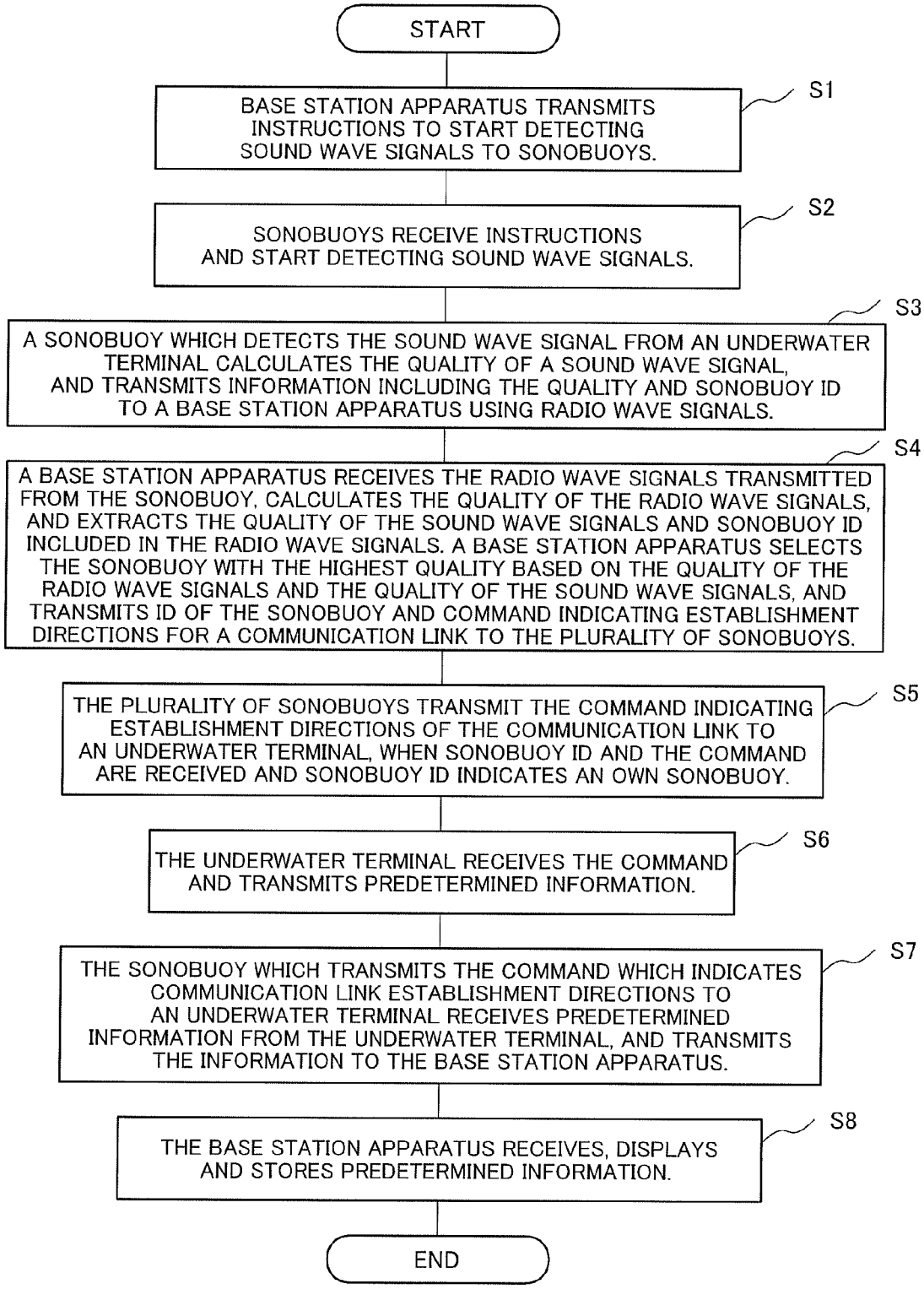
FIG. 2 is a flow chart showing an example of operation of the first exemplary embodiment of the communication system of a present invention.

FIG. 2 shows an example of operation of the first exemplary embodiment of the communication system of the present invention.

An operator of the system arranges the sonobuoys 2-1 and 2-2 at a predetermined interval in a sea area where the underwater terminal 1 is likely to exist. The underwater terminal 1 installed in the movable body transmits a control signal including SOS as sound wave signals, when the movable body wrecked. Being installed in the sea bottom, the underwater terminal 1 transmits the control signal which shows existence thereof as sound wave signals.

In Step 1 (S1) of FIG. 2, when the operator inputs instructions into the base station apparatus 3 for starting communication with the underwater terminal 1, the base station apparatus 3 transmits an instruction for starting detection of the sound wave signal transmitted by the underwater terminal 1 to the sonobuoys 2-1 and 2-2 through radio wave signals.

In Step 2 (S2) of FIG. 2, the sonobuoys 2-1 and 2-2 receive the radio wave signals which instruct to start detection of the sound wave signal, and start to detect the sound wave signals being transmitting from the underwater terminal 1.

In Step 3 (S3) of FIG. 2, the sonobuoy which can detect the sound wave signals calculates a signal quality of the detected sound wave signal. The signal quality is calculated based on intensity of the detected sound wave signal, for example. The sonobuoy informs the base station apparatus 3 of detection of the sound wave signal using radio wave signals, and further transmits information including the signal quality of the sound wave signal and own sonobuoy ID to the base station apparatus 3 using the radio wave signals.

In Step 4 (S4) of FIG. 2, the base station apparatus 3 receives each radio wave signals transmitted by the sonobuoys 2-1 and 2-2 during a predetermined period of time (e.g. 5 minutes, the period is optionally changeable), and calculates quality of each of the radio wave signals. The quality of the radio wave signal is calculated based on intensity of the detected radio wave signal (e.g. magnitude of received power of the radio wave signal). After elapse of the period, the base station apparatus 3 selects a sonobuoy having the best total communication quality on a sound wave path and a radio wave path based on the calculated quality of the radio wave signal and the quality of the sound wave signal which sonobuoy 2-1 and 2-2 transmit. In order to establish a communication link with the selected sonobuoy, the base station apparatus 3 transmits sonobuoy ID of the selected sonobuoy and a command for establishing the communication link to the sonobuoys using radio wave signals.

In Step 5 (S5) of FIG. 2, the sonobuoys 2-1 and 2-2 receive the sonobuoy ID and the command respectively, and investigate whether or not the sonobuoy ID corresponds to the own ID. The sonobuoy which receives the own ID transmits the command for establishing the communication link to the underwater terminal 1 using the sound wave signals.

In Step 6 (S6) of FIG. 2, the underwater terminal 1 receives the command through the sound wave signals from the selected sonobuoy, and transmits information including position information and environment information (e.g. temperature, quantity of light, sound pressure, images, pictures, etc.) to the sonobuoys using the sound wave signals.

In Step 7 (S7) of FIG. 2, the sonobuoy which transmits the command receives the information from the underwater terminal 1 through the sound wave signals, and transmits the information to the base station apparatus 3 using the radio wave signals.

In Step 8 (S8) of FIG. 2, the base station apparatus 3 receives the information transmitted from the sonobuoy using the radio wave signals, and displays, reports or memorizes the information.

In the communication system of the first exemplary embodiment, initially an operator arranges the sonobuoys 2-1 and 2-2 at a predetermined interval in a sea area where the underwater terminal 1 is likely to exist. The operator inputs the instruction for starting communication with the underwater terminal 1. When the operator inputs the instructions, the base station apparatus 3 can communicate with the underwater terminal via one of the sonobuoys 2-1 and 2-2 as follows. That is, in the communication system, the sonobuoys 2-1 and 2-2 receive the control signals from the underwater terminal 1 through sound wave signals. The sonobuoys 2-1 and 2-2 which receive the control signal from the underwater terminal 1 transmit information including the quality of the received sound wave signal to the base station apparatus 3 using the radio wave signals. The base station apparatus 3 selects a sonobuoy having the best total communication quality based on the quality of the radio wave signals received from the sonobuoys and the information on quality of the sound wave signal included in the radio wave signals, and communicates with the underwater terminal 1 via the selected sonobuoy.

Thus, the communication system of the first exemplary embodiment differs from a communication system having one sonobuoy and does not need to repeat the operation to arrange a sonobuoy in order to search for an optimal sound wave communication path. The operation for arranging sonobuoys in the communication system of the first exemplary embodiment can be performed in a short time. For this reason, the communication system in the first exemplary embodiment can quickly cope with emergency such as underwater distress of a submarine and the like.

In the communication system of the first exemplary embodiment, the base station apparatus 3 chooses the sonobuoy with the most optimal communication quality from the sonobuoy 2-1 and 2-2 and communicates with the underwater terminal 1 via the sonobuoy. Risks of the communication path disconnection between underwater terminal 1 and the base station apparatus 3 can be reduced as compared with the communication system with one sonobuoy.

Next, a second exemplary embodiment of the communication system of the present invention will be described with reference to FIGS. 3-9.

Figure 3:
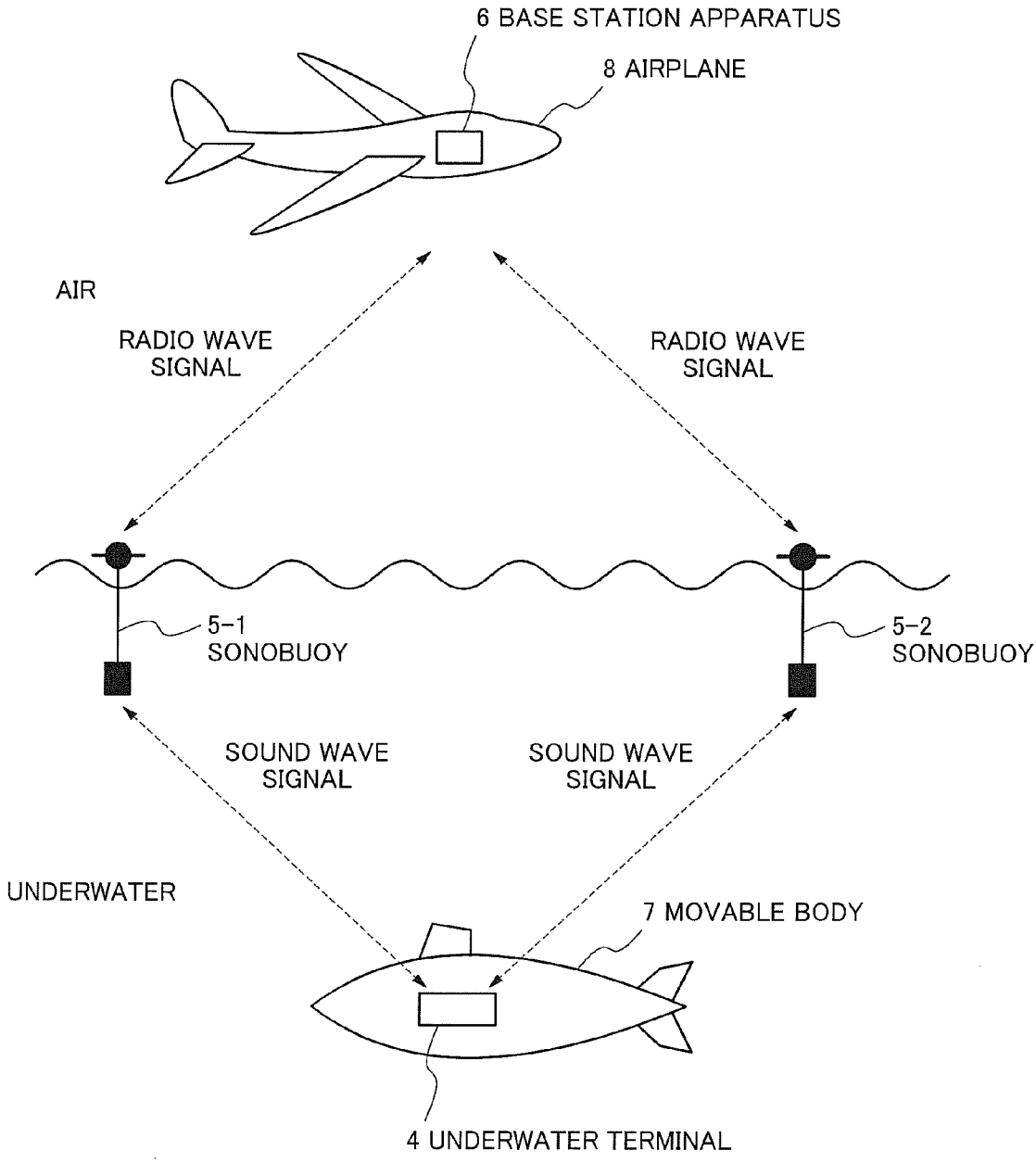
FIG. 3 is a drawing showing a second exemplary embodiment of the communication system of the present invention.

FIG. 3 shows the second exemplary embodiment of the communication system of the present invention.

The communication system of the present invention shown in FIG. 3 includes an underwater terminal 4 installed in an underwater movable body 7, and two sonobuoys 5-1 and 5-2 installed near a water surface, and a base station apparatus 6 installed in an airplane 8 in the air.

The movable body 7 is a submarine, a deep sea research vessel or the like. The underwater terminal 4 may be fixed on the sea bottom. The base station apparatus 6 may be installed in a land control station or a vessel. The two sonobuoys are shown in FIG. 3. More than two sonobuoys are also available. Each of the sonobuoys 5-1 and 5-2 transmits and receives sound wave signals to and from the underwater terminals 4 and transmits and receives radio wave signals to and from the base station apparatus 6 to relay communication therebetween. The sonobuoys 5-1 and 5-2 include sonobuoy ID to identify each of sonobuoys. When communication between the sonobuoys 5-1 and 5-2 and the base station apparatus 6 is performed, the sonobuoy ID information is transmitted with other information as radio wave signals. Each of the sonobuoys 5-1 and 5-2 transmits radio wave signals with different carrier frequency to the base station apparatus 6. The base station apparatus 6 transmits radio wave signals of a specific carrier frequency to each of the sonobuoys 5-1 and 5-2.

Figure 4:
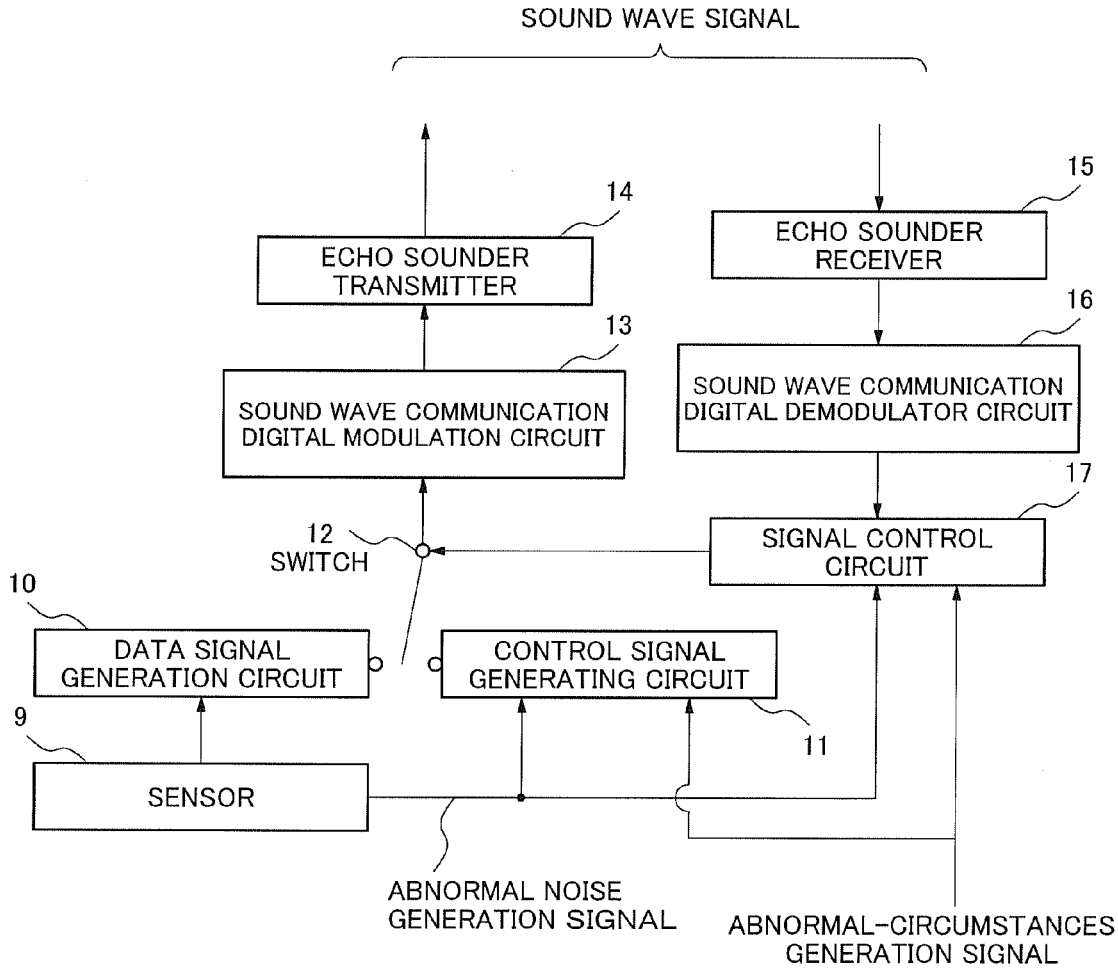
FIG. 4 is a block diagram showing an example of an underwater terminal.

FIG. 4 is a block diagram showing an example of the underwater terminal 4.

The underwater terminal 4 includes a sensor 9, a data signal generating circuit 10, a control signal generating circuit 11, a switch 12, a sound wave communication digital modulation circuit 13, an echo sounder transmitter 14, an echo sounder receiver 15, a sound wave communication digital demodulator circuit 16, and a signal control circuit 17.

The sensor 9 detects physical quantity (e.g. temperature, quantity of light, sound pressure, images, and pictures), and outputs electric signals corresponding to the physical quantity as environment information. When an abnormal noise is detected (e.g. when the detected sound has bigger sound pressure than a predetermined sound pressure), the sensor 9 outputs an abnormal noise generation signal to the control signal generating circuit 11. The data signal generating circuit 10 converts the electric signals inputted from the sensor 9 into digital data, and generates digital bit series signals corresponding to a type of signals or amount of variation of signal change.

On reception of a signal notifying occurrence of abnormal circumstances from the movable body, the control signal generating circuit 11 outputs a control signal including SOS information as digital bit series signals such as a beacon signal. On reception of the abnormal noise generation signal from the sensor 9, the control signal generating circuit 11 outputs a control signal including abnormal noise occurrence information as digital bit series signals such as a beacon signal.

When the underwater terminal 4 is fixed on the sea bottom, the control signal generating circuit 11 outputs a control signal including position information which indicates a position of the underwater terminal 4 as digital bit series signals such as beacon signals. The switch 12 selects either digital bit series signals generated by the data signal generation circuit 10 or digital bit series signals generated by the control signal generating circuit 11 to send them to the sound wave communication digital modulation circuit 13 according to selection instructions from the signal control circuit 17.

The sound wave communication digital modulation circuit 13 receives the signal of the digital bit series through the switch 12 and outputs digitally modulated electric signals. The echo sounder transmitter 14 converts electric signals outputted by the sound wave communication digital modulation circuit 13 into sound wave signals corresponding to modulation ingredients. The echo sounder receiver 15 receives sound wave signals and converts the sound wave signals into electric signals. The sound wave signal digital demodulator circuit 16 demodulates modulation ingredients included in the electric signals outputted by the echo sounder receiver 15 and outputs digital bit series signals.

When the abnormal noise generation signal is received from the sensor 9, the signal control circuit 17 sends to the switch 12 a selection instruction to select signals generated by the control signal generating circuit 11. When abnormal circumstance occurs in a movable body, the signal control circuit 17 receives an abnormal circumstances generation signal from the movable body, and sends to the switch 12 the selection instruction to select signals generated by the control signal generating circuit 11. The signal control circuit 17 decodes the digital bit series signals which the sound wave communication digital demodulator circuit 16 demodulated and sends the selection instruction based on contents of the signals to the switch 12.

Figure 5:
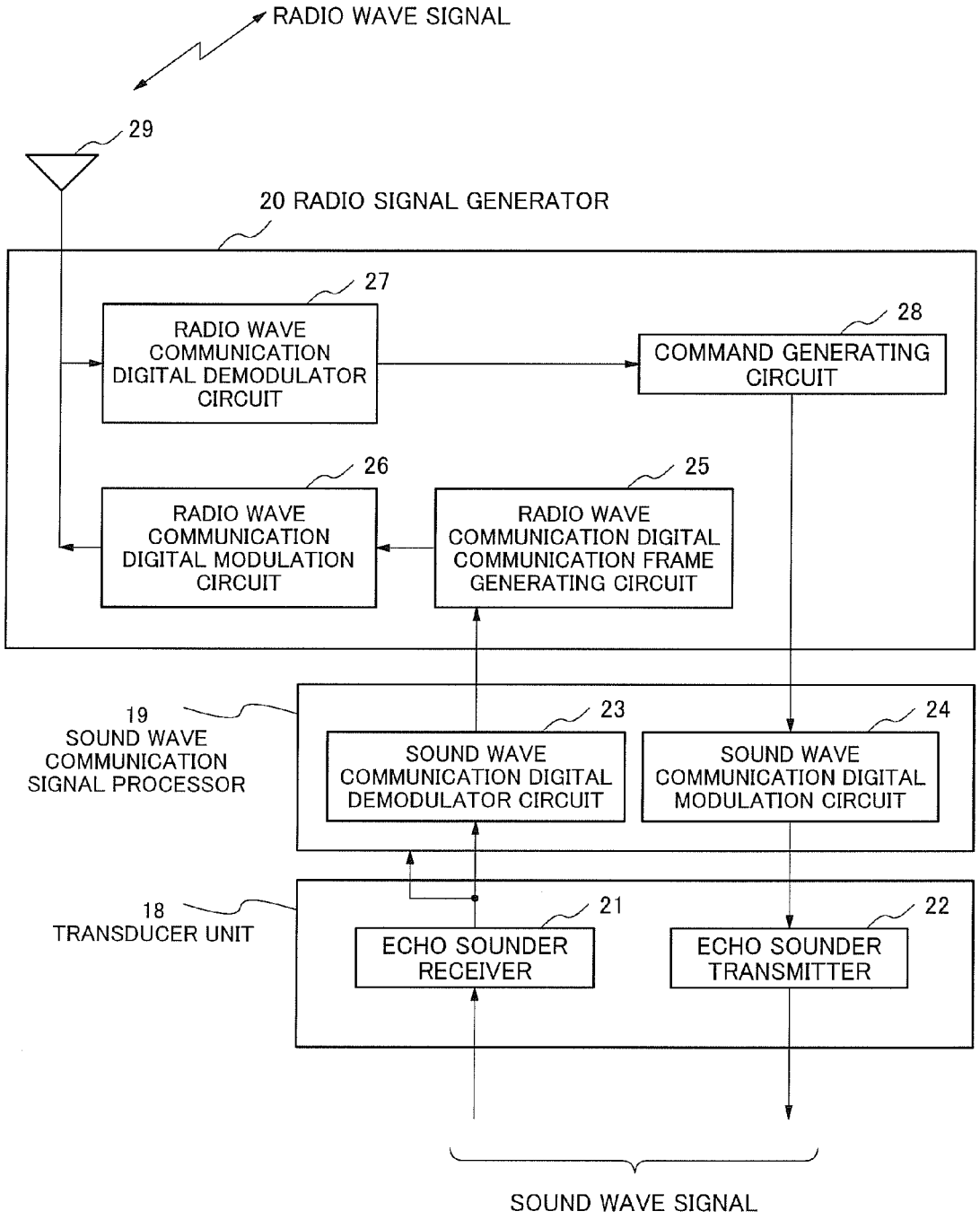
FIG. 5 is a block diagram showing an example of a sonobuoy.

FIG. 5 is a block diagram showing an example of a sonobuoy.

Each of sonobuoys 5-1 and 5-2 includes a transducer unit 18, a sound wave communication signal processor 19 and a radio signal generator 20.

The transducer unit 18 includes an echo sounder receiver 21 and an echo sounder transmitter 22. The sound wave communication signal processor 19 includes a sound wave communication digital demodulator circuit 23 and a sound wave communication digital modulation circuit 24. The radio signal generator 20 includes a radio communication digital communication frame generating circuit 25, a radio wave communication digital modulation circuit 26, an antenna 29, a radio wave communication digital demodulator circuit 27 and a command generating circuit 28.

Figure 6:
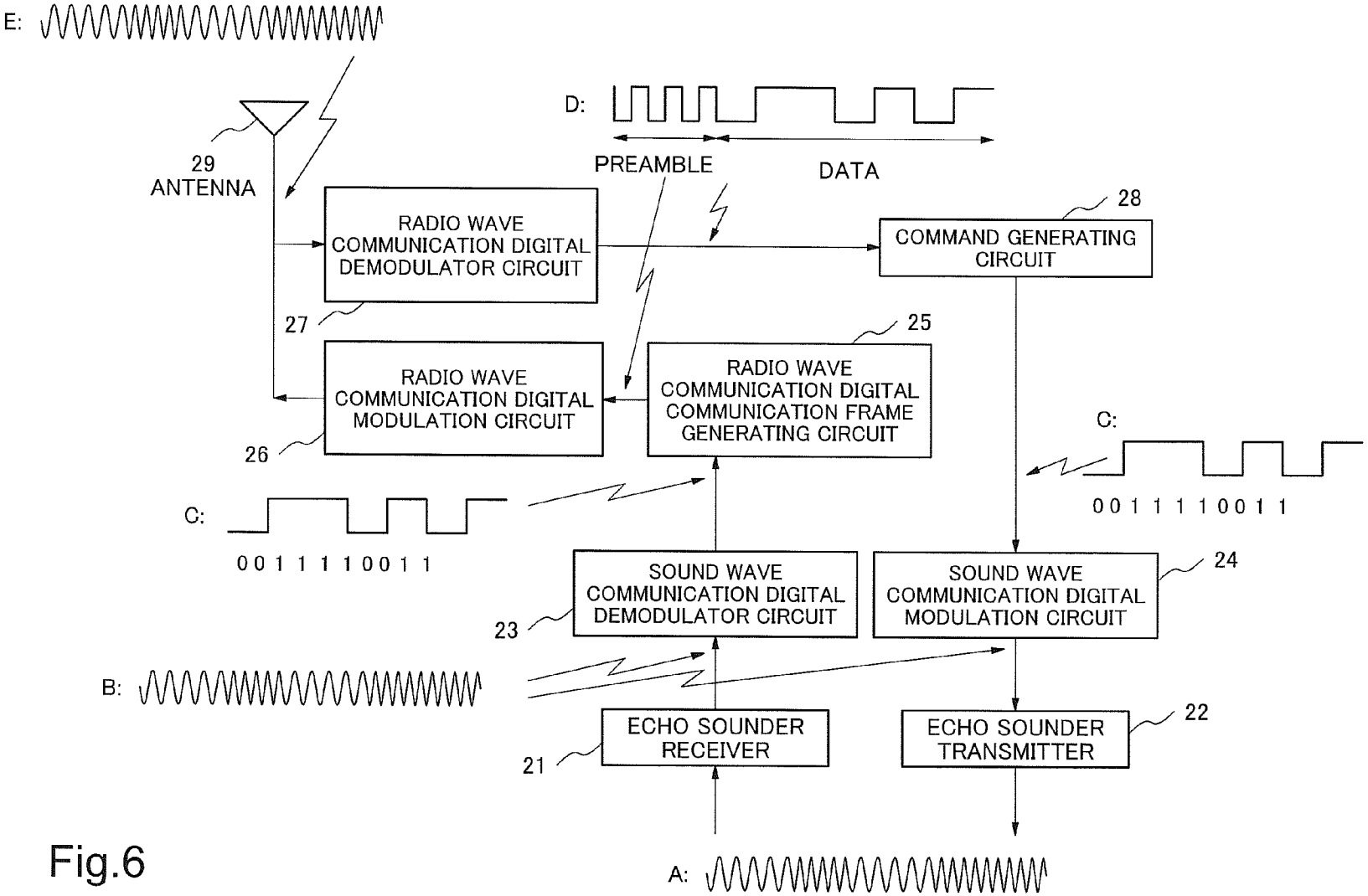
FIG. 6 shows an example of signal aspects in main parts of a sonobuoy.

Here, FIG. 6 shows an example of form of each signal which is input and output by the echo sounder transmitter 22, the echo sounder receiver 21, the antenna 29 and each circuit respectively. "A" shows a form of the sound wave signal which the echo sounder receiver 21 receives and the echo sounder transmitter 22 transmits. "B" shows a form of the electric signal which the sound wave communication digital demodulator circuit 23 inputs and the sound wave communication digital modulation circuit 24 outputs. "C" shows a form of the electric signal which the radio wave communication digital communication frame generating circuit 25 inputs and the command generating circuit 28 outputs. "D" shows a form of the electric signal which the radio wave communication digital modulation circuit 26 inputs and the radio wave communication digital demodulator circuit 27 outputs. "E" shows a form of the radio signal which the antenna 29 transmits and receives. The sound wave signal A is used for communication with the underwater terminal 4 and includes modulation ingredients corresponding to communication information. The electric signal B is the electrical signal converted from the sound wave signal by the echo sounder receiver 21, and is also the electrical signal to be converted into the sound wave signal by the echo sounder transmitter 22. The electric signal B includes modulation ingredients corresponding to communication information. The electric signal C is the digital signal to be processed in each processing unit of the sonobuoy and is also digital bit series signals corresponding to communication information. The electric signal D is a signal which adds a preamble to the digital bit series of the electric signal C. The preamble is a known digital bit series including information and a like for digital-synchronizing at a receiving end. The radio signal E is used for communication with the base station apparatus 6 and includes modulation ingredients corresponding to communication information.

The echo sounder receiver 21 shown in FIG. 5 receives sound wave signals which the underwater terminal 4 outputted, and converts the sound wave signal into the electric signal. Then, the transducer unit 18 measures intensity of the sound wave signal received by the echo sounder receiver 21 and outputs the intensity as quality information of the sound wave signal. The sound wave communication digital demodulator circuit 23 demodulates modulation ingredients included in the electric signal outputted from the echo sounder receiver 21 and outputs the digital bit series signals. Then, the sound wave communication signal processor 19 receives the quality information of the sound wave signal from the transducer unit 18, and adds the quality information to the digital bit series signals outputted by the sound wave communication digital demodulator circuit 23. The digital bit series signals having the quality information is outputted as a signal of a new digital bit series.

The radio wave communication digital communication frame generating circuit 25 of the sonobuoys 5-1 and 5-2 receives the digital bit series signals from the sound wave communication signal processor 19. The radio wave communication digital communication frame generating circuit 25 converts the digital bit series signals into a format for radio wave digital communication and outputs the converted digital bit series signals. The format is a format in which a preamble of a digital bit series is added to a head part of the signal of a digital bit series, for example. The radio wave communication digital modulation circuit 26 modulates the digital bit series signals received from the radio wave communication digital communication frame generating circuit 25 with a specific carrier frequency of the sonobuoy. The antenna 29 transmits the radio wave signals which the radio wave communication digital modulation circuit 26 has modulated by the specific carrier frequency of the sonobuoy. The antenna 29 receives the radio wave signals transmitted from the base station apparatus 6. The radio wave communication digital demodulator circuit 27 demodulates the radio wave signals received by the antenna 29 and outputs digital bit series signals. The digital bit series signals enter the command generating circuit 28. The command generating circuit 28 extracts control information transmitted by the base station apparatus 6 from the digital bit series signals, and outputs the control information. When the control information includes a sound wave signal detection starting instruction, the sonobuoys 5-1 and 5-2 begin to detect sound wave signals. The sound wave communication digital modulation circuit 24 receives the digital bit series signals transmitted by the command generating circuit 28 and performs digital modulation to output modulated signal. The echo sounder transmitter 22 receives the modulated electric signal from the sound wave communication digital modulation circuit 24, converts the modulated electric signal into sound wave signals corresponding to modulation ingredients, and transmits the sound wave signals to underwater terminal 4.

Figure 7:
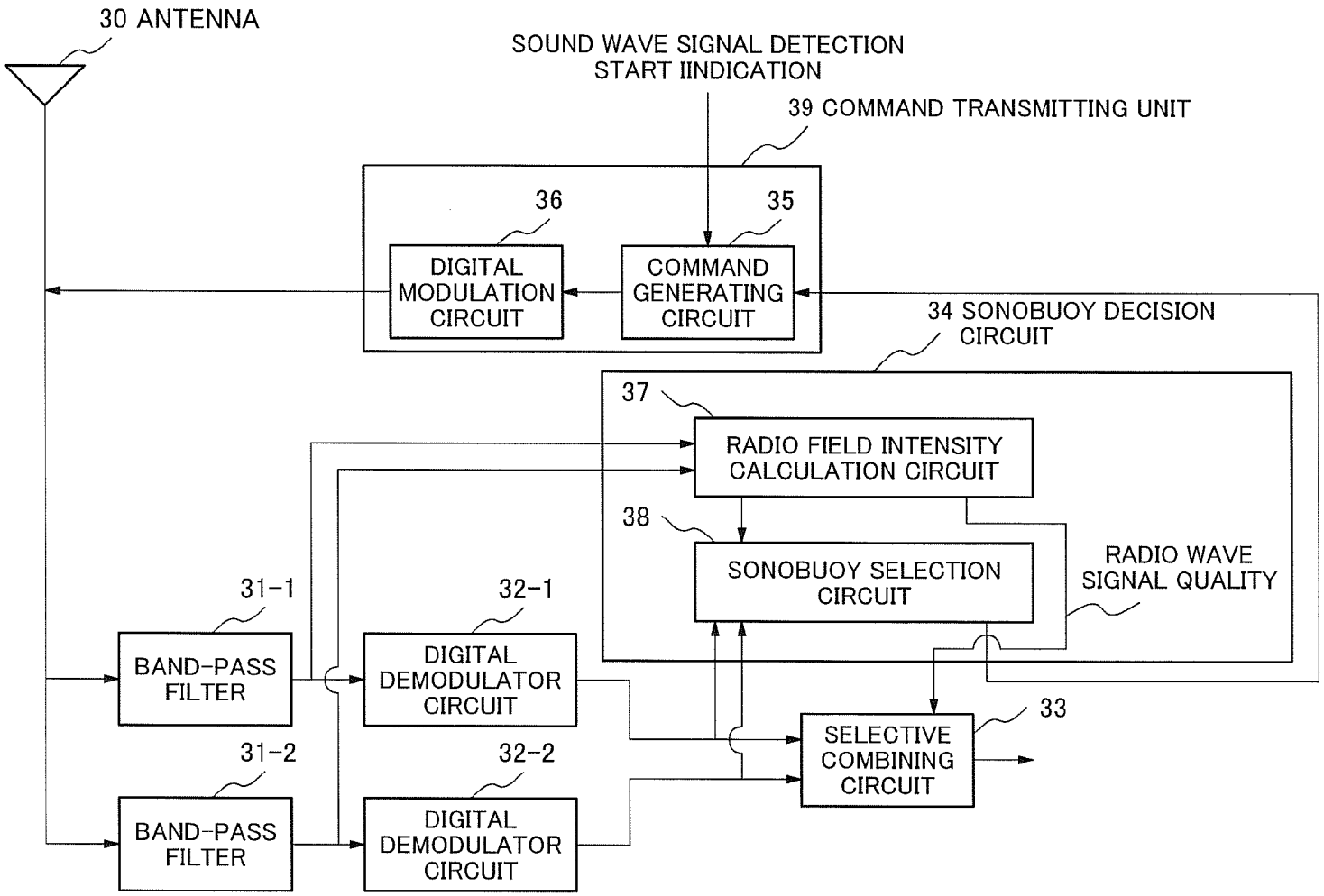
FIG. 7 is a block diagram showing an example of a base station apparatus.

FIG. 7 is a block diagram showing an example of a base station apparatus.

The base station apparatus 6 includes an antenna 30, band-pass filters 31-1, 31-2, digital demodulator circuits 32-1, 32-2, a selective combining circuit 33, sonobuoy decision circuit 34 and a command transmission unit 39. The command transmission unit 39 includes a command generating circuit 35 and a digital modulation circuit 36.

The sonobuoy decision circuit 34 includes a radio field intensity calculation circuit 37 and a sonobuoy selection circuit 38.

The band-pass filters 31-1 and 31-2 correspond to the sonobuoys 5-1 and 5-2 respectively. The digital demodulator circuits 32-1 and 32-2 correspond to the band-pass filters 31-1 and 31-2 respectively. The antenna 30 receives radio wave signals which the sonobuoys 5-1 and 5-2 transmit. The carrier frequencies (modulation frequencies) of radio wave signals transmitted from the sonobuoys 5-1 and 5-2 are different from each other. Each of the band-pass filters 31-1 and 31-2 passes radio wave signals of the carrier frequency corresponding to each of the sonobuoys 5-1 and 5-2 by filtering the radio wave signals received by the antenna 30.

Each of digital demodulator circuits 32-1 and 32-2 receives the radio wave signals corresponding to each of sonoubys 5-1 and 5-2 selected by the corresponding band-pass filters 31-1 and 31-2 and modulates the radio wave signals to obtain digital bit series signals as communication information. Each of the digital demodulator circuits 32-1 and 32-2 decodes the digital bit series signals, extracts the quality information of the sound wave signal included in the digital bit series signals and outputs the signal of digital bit series indicating the quality information and the communication information respectively.

The radio field intensity calculation circuit 37 of the sonobuoy decision circuit 34 measures radio wave signal intensity (i.e. magnitude of an electric power of a radio wave signal) of each frequency band (i.e. each carrier frequency) based on the radio wave signals received from each of the band-pass filters 31-1 and 31-2, and defines the radio wave signal intensity as quality information of the radio wave signal corresponding to each of the sonobuoys 5-1 and 5-2.

The sonobuoy selection circuitry 38 of the sonobuoy decision circuit 34 determines a transmitting sonobuoy which can transmit and receive signals to and from underwater terminal 4, a receiving sonobuoy which can only receive signals from underwater terminal 4, and a communication impossible sonobuoy which cannot transmit and receive signals to and from the underwater terminal 4 based on each quality information of the radio wave signal measured by the radio field intensity calculation circuit 37 and each quality information of the sound wave signal outputted by the digital demodulator circuits 32-1 and 32-2. Here, the transmitting sonobuoy is the sonobuoy having the highest communication quality in the sonobuoys in which both two communication quality exceed a specified level. The communication impossible sonobuoy is a sonobuoy which is below at least one of two specified communication quality levels. The receiving sonobuoy is a sonobuoy except for the transmitting sonobuoy and the communication impossible sonobuoy. The transmitting sonobuoy transmits and receives sound wave signals to and from the underwater terminal 4 and transmits information from the underwater terminal 4 to the base station apparatus 6 using radio wave signals. The receiving sonobuoy receives sound wave signals from the underwater terminal 4 and transmits information from the underwater terminal 4 to the base station apparatus 6 using radio wave signals. The communication impossible sonobuoy does not transmit and receive any signal to and from the underwater terminal 4 and therefore does not transmit information from the underwater terminal 4 to the base station apparatus 6.

The selective combining circuit 33 performs diversity reception by selection combining processing of digital bit series signals outputted by each of the digital demodulator circuits 32-1 and 32-2.

The command generating circuit 35 receives control information from the sonobuoy decision circuit 34 and outputs digital bit series signals corresponding to the control information. The command generating circuit 35 receives instructions for starting detection of sound wave signals from an operator of the system and outputs digital bit series signals indicating the instructions.

The digital modulation circuit 36 receives digital bit series signals from the command generating circuit 35, modulates the digital bit series signal and outputs the radio wave signal as a modulated signal.

The antenna 30 transmits the radio wave signal which the digital modulation circuit 36 transmits.

Next, an example of operation of the communication system of the exemplary embodiment will be described in detail with reference to FIG. 3 to FIG. 8.

Figure 8:
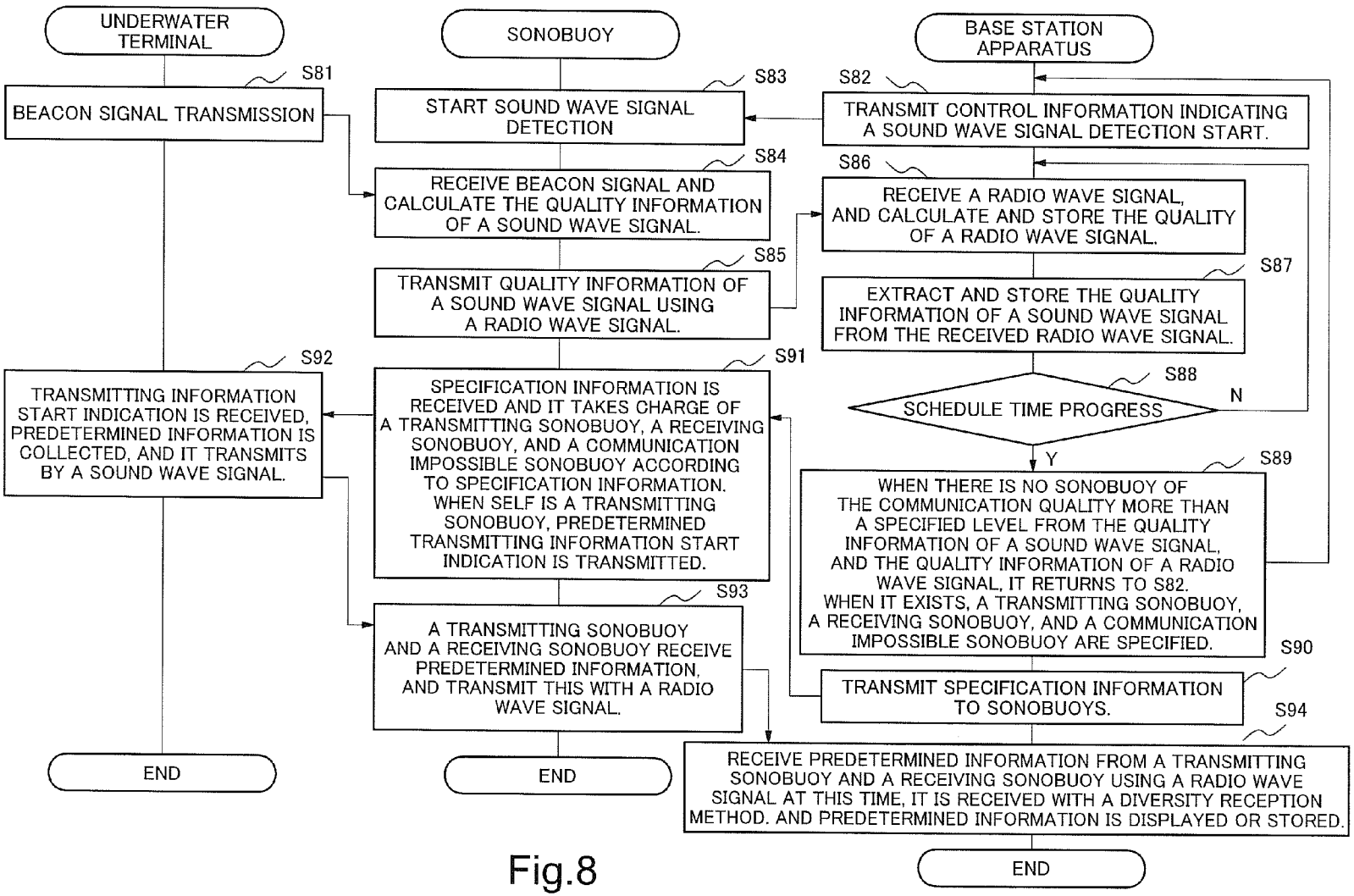
FIG. 8 is a flow chart showing an example of operation of the second exemplary embodiment of a communication system of the present invention.

FIG. 8 is a flowchart showing an example of operation of the second exemplary embodiment of the communication system of the present invention.

In Step 81 (S81) of FIG. 8, the underwater terminal 4 installed in the movable body 7 receives a signal of occurrence of abnormal circumstances from a sensor in the movable body 7 when abnormality (e.g. distress) occurs in the movable body 7. The underwater terminal 4 transmits a control signal including SOS information as a beacon signal using sound wave signals.

That is, more in detail, the signal control circuit 17 of the underwater terminal 4 installed in the movable body 7 receives the signal of occurrence of abnormal circumstances from the movable body 7 and outputs a selection instruction to select signals generated by the control signal generating circuit 11 to the switch 12. The control signal generating circuit 11 of the underwater terminal 4 receives the signal of occurrence of abnormal circumstances and transmits the control signal including SOS information as a beacon signal. The control signal including the SOS information is transmitted as a beacon signal via the sound wave communication digital modulation circuit 13 and the echo sounder transmitter 14 using sound wave signals.

In a system in which the underwater terminal 4 is not installed in a movable body, but for example is fixed on the sea bottom, the underwater terminal 4 transmits a control signal including location information indicating own position as a beacon signal at a predetermined time interval set in advance using sound wave signals. Here, the location information indicating own position indicates the position of the underwater terminal 4 fixed on the sea bottom. The selection instruction to select signals generated by the control signal generating circuit 11 is transmitted to the switch 12 in advance. The control signal generating circuit 11 of the underwater terminal 4 transmits the control signal including location information which indicates the position of the underwater terminal 4 as a beacon signal at a predetermined time interval.

Here, as shown in FIG. 3, an operator of the system arranges the sonobuoys 5-1 and 5-2 at a predetermined interval in the sea area where the underwater terminal 4 is likely to exist.

In Step 82 (S82) of FIG. 8, when an operator of the system instructs sonobuoys to start detecting sound wave signals through the base station apparatus 6, the base station apparatus 6 transmits control information including the instructions to start detecting sound wave signals transmitted by the underwater terminal 4 to sonobuoys 5-1 and 5-2 using radio wave signals.

That is, according to the instruction of the operator of the system, the command generating circuit 35 of the base station apparatus 6 outputs the control information including the instructions to start detecting sound wave signals. The digital modulation circuit 36 outputs the radio wave signals modulated according to the digital bit series which the control information indicates. The antenna 30 transmits the modulated radio wave signals to the sonobuoys 5-1 and 5-2.

In Step 83 (S83) of FIG. 8, the sonobuoys 5-1 and 5-2 receive the control information including the instructions to start detecting sound wave signals which the base station apparatus 6 transmits using radio wave signals, and start detecting the sound wave signals transmitted by the underwater terminal 4.

That is, the sonobuoys 5-1 and 5-2 receive, using the antenna 29, the radio wave signals including the control information which the base station apparatus 6 transmits. The radio communication digital demodulator circuit 27 demodulates the radio wave signals received by the antenna 29 to make digital bit series signals corresponding to the control signal. The command generating circuit 28 extracts the control information from the digital bit series signals. Since the extracted control information is a signal which instructs to start detecting sound wave signals, the sonobuoys 5-1 and 5-2 start to detect the sound wave signals respectively.

In Step 84 (S84) of FIG. 8, the sonobuoys 5-1 and 5-2 detect the sound wave signals which the underwater terminal 4 transmits. One or more sonobuoys which can detect the sound wave signals calculate quality of the detected sound wave signals.

That is, the echo sounder receiver 21 receives the sound wave signals which the underwater terminal 4 outputs, converts the sound wave signals into electric signals. The transducer unit 18 measures intensity of the sound wave signal received by the echo sounder receiver 21 and outputs the intensity as quality information on the sound wave signal.

In Step 85 (S85) of FIG. 8, one or more sonobuoys which can detect the sound wave signals in Step 84 (S84) transmit the quality information on the sound wave signal to the base station apparatus 6 using radio wave signals.

That is, the sound wave communication signal processor 19 of the sonobuoy which can detect the sound wave signals in Step 84 (S84) of FIG. 8 receives the quality information on the sound wave signal outputted by the transducer unit 18 and outputs the quality information as digital bit series signals. Radio wave signals modulated by a carrier frequency specific to the sonobuoy is transmitted to the base station apparatus 6 from the antenna 29 via the radio wave communication digital communication frame generating circuit 25 and the radio wave communication digital modulation circuit 26. The radio wave signals transmitted from the antenna 29 includes the quality information on the sound wave signal.

In Step 86 (S86) of FIG. 8, the base station apparatus 6 receives the radio wave signals transmitted from one or more sonobuoys which can detect the sound wave signals in Step 84 (S84) of FIG. 8 and calculates quality on the radiowave signal and stores the quality.

That is, the base station apparatus 6 receives the radio wave signals transmitted from the sonobuoy which can detect the sound wave signals in Step 84 (S84) of FIG. 8 by the antenna 30. The band-pass filter of the base station apparatus 6 corresponding to the sonobuoy passes the radio wave signals of the carrier frequency specific to the sonobuoy from the received radio signals. The radio field intensity calculation circuit 37 measures intensity of the radio wave signal having passed through each of the band-pass filters. The sonobuoy decision circuit 34 links with the measurement result, that is, the quality information on the radio wave signal corresponding to each of the sonobuoys, with the sonobuoy ID, and stores the result.

In Step 87 (S87) of FIG. 8, the base station apparatus 6 decodes the radio wave signals received from one or more sonobuoys in Step 86 of FIG. 8, extracts the quality information on the sound wave signal in the received signals and stores the quality information.

That is, each of the digital demodulator circuits 32-1 and 32-2 receives and demodulates the radio wave signals which each of the band-pass filters 31-1 and 31-2 selects at Step 86 (S86) of FIG. 8, respectively, and obtains corresponding digital bit series signals. Each of the digital demodulator circuits 32-1 and 32-2 decodes the demodulated digital bit series signals, extracts the quality information on the sound wave signals, and outputs the quality information and the demodulated digital bit series signals. The sonobuoy decision circuit 34 links with the quality information of the sound wave signal, that is, the quality information on the radio wave signal corresponding to each of the sonobuoys, with the sonobuoy ID, and stores each quality information.

In Step 88 (S88) of FIG. 8, the base station apparatus 6 examines whether or not a predetermined time passes, and when having not passed, returns to Step 86 (S86) of FIG. 8 and repeats Step 86 and Step 87 of FIG. 8.

When the predetermined time has passed, Step 89 (S89) of FIG. 8 is followed. For example, the predetermined time is 5 minutes. The predetermined time may be changed appropriately.

In Step 89 (S89) of FIG. 8, the sonobuoy selection circuitry 38 of the base station apparatus 6 classifies sonobuoys with totally sufficient communication quality based on the quality information on the sound wave signal and the quality information on the radio wave signal corresponding to each sonobuoy stored in the sonobuoy decision circuit 34.

That is, the sonobuoy selection circuit 38 classifies sonobuoys as follows.

(1) A sonobuoy with radio wave quality and sound wave quality more than a specified level in all the sonobuoys and with the most sufficient communication quality in all the sonobuoys is selected as a transmitting sonobuoy. Here, the specified level means, in radio wave quality, a 5% larger intensity of the radio wave than the minimum intensity of the radio wave which the digital demodulator circuit 32 of the base station apparatus 6 can demodulate (that is "receiver sensitivity"), for example. The specified level means, in sound wave quality, a 5% larger intensity of the sound wave than the minimum intensity of the sound wave which the sound wave communication digital demodulator circuit 23 of the sonobuoy 5 can demodulate (that is "receiver sensitivity"), for example. The specified level may be defined appropriately by a system. Sonobuoys with radio wave quality and sound wave quality more than the specified level except for the transmitting sonobuoy are specified as receiving sonobuoys. Sonobuoys in which one of radio wave quality and the sound wave quality thereof does not reach the specified level are specified as a communication impossible sonobuoy. The sonobuoy selection circuit 38 specifies each sonobuoy as a transmission sonobuoy, a receiving sonobuoy and a communication impossible sonobuoy respectively. And the sonobuoy selection circuit 38 adds corresponding sonobuoy ID to the respective specification information and outputs the specification information as the control information. And Step 90 (S90) of FIG. 8 can be followed.

(2) On the other hand, when the sonobuoy selection circuit 38 specifies all sonobuoys as the communication impossible sonobuoys, an operator of the system relocates sonobuoys in the sea area where better communication quality is likely to be obtained. That is, an operator of the system collects the currently arranged sonobuoys 5-1 and 5-2 and rearranges the sonobuoys on other sea area where the underwater terminal 4 is likely to exist at a predetermined interval. If the base station apparatus 6 is movable, the base station apparatus 6 may approach a sonobuoy in good sound wave environment (i.e. sonobuoy having good quality of sound wave signal) as much as possible. And Step 82 (S82) of FIG. 8 can be followed.

In Step 90 (S90) of FIG. 8, the base station apparatus 6 transmits the control information including the specification information to the sonobuoys 5-1 and 5-2. The specification information includes the respective sonobuoy ID which the sonobuoy selection circuit 38 outputs in Step 89 (S89) of FIG. 8.

That is, the command generating circuit 35 receives the control information outputted by the sonobuoy decision circuit 34 and outputs the control information as digital bit series signals. The digital modulation circuit 36 modulates the digital bit series signals and transmits the radio wave signals from the antenna 30.

In Step 91 (S91) of FIG. 8, each of the sonobuoys 5-1 and 5-2 receives the control information including the specification information with the sonobuoy ID transmitted by the base station apparatus 6 as radio wave signals. Each of the sonobuoys 5-1 and 5-2 extracts the specification information corresponding to sonobuoy ID thereof in the control information, and performs a process according to the specification information.

That is, by the antenna 29, each of the sonobuoys 5-1 and 5-2 receives the control information which the base station apparatus 6 transmitted as radio wave signals. By the radio wave communication digital demodulator circuit 27, the received radio wave signal is demodulated in the digital bit series signals. Next, by the command generating circuit 28, each of the sonobuoys 5-1 and 5-2 extracts the control information from the digital bit series signals and takes out the specification information corresponding to the sonobuoy ID from the control signal. A sonobuoy specified as the transmitting sonobuoy by the specification information transmits and receives sound wave signals to and from the underwater terminals 4. A sonobuoy specified as the receiving sonobuoy by the specification information receives the sound wave signals from the underwater terminal 4. A sonobuoy specified as the communication impossible sonobuoy by the specification information does not perform communication with the underwater terminal 4. The command generating circuit 28 in the communication impossible sonobuoy temporarily stops functions of the transducer unit 18 and the like to save electric power consumption.

The command generating circuit 28 in the transmitting sonobuoy outputs an instruction to start transmitting information. The sound wave communication digital modulation circuit 24 converts the digital bit series signals indicating the instruction to start transmitting information into modulated electrical signals. The echo sounder transmitter 22 transmits sound wave signals converted from the electric signals.

In Step 92 (S92) of FIG. 8, the underwater terminal 4 receives the sound wave signals indicating the instruction to start transmitting information from the transmitting sonobuoy, collects predetermined information and transmits the collected information using sound wave signals.

That is, by the echo sounder receiver 15, the underwater terminal 4 receives the sound wave signals including the instruction to start transmitting information from the transmitting sonobuoy. The sound wave communication digital demodulator circuit 16 demodulates the signals transmitted by the sound wave signals and outputs digital bit series signal. The signal control circuit 17 decodes the digital bit series signals which the sound wave communication digital demodulator circuit 16 outputs to recognize the signal as the instruction to start transmitting information. The signal control circuit 17 outputs the selection instruction to select signals outputted by the data signal generation circuit 10 to the switch 12. The switch 12 selects the signals outputted by the data signal generation circuit 10 based on the selection instruction and leads the signals to the sound wave communication digital modulation circuit 13. The signals which the data signal generation circuit 10 outputs are digital bit series signals indicating environmental information (physical quantity such as temperature, light quantity, sound pressure, images and pictures) detected by the sensor 9. The sound wave communication digital modulation circuit 13 receives the signals (digital bit series signals) selected by the switch 12, converts the signals into modulated electric signals. The echo sounder transmitter 14 receives the electric signals indicating the environmental information generated by the sound wave communication digital modulation circuit 13 and transmits sound wave signals converted from the electric signals.

In Step 93 (S93) of FIG. 8, the transmitting sonobuoy and the receiving sonobuoy receive sound wave signals indicating the environmental information transmitted by the underwater terminal 4 respectively and transmit the environmental information to the base station apparatus 6 using radio wave signals.

That is, by the echo sounder receiver 21, the transmitting sonobuoy and the receiving sonobuoy receive the sound wave signals indicating environmental information outputted by the underwater terminal 4 and convert the sound wave signals into electric signals. The electrical signals indicating the environment information outputted by the echo sounder receiver 21 is changed to the digital bit series signals indicating the environment information via the sound wave communication digital demodulator circuit 23 and the radio wave communication digital communication frame generating circuit 25. The digital bit series signals is modulated by the radio wave communication digital modulation circuit 26 and the radio wave signals indicating the environmental information are transmitted from the antenna 29.

In Step 94 (S94) of FIG. 8, the base station apparatus 6 receives the environmental information transmitted by the transmitting sonobuoy and the receiving sonobuoy as radio wave signals and demodulates the received respective radio wave signals. The base station apparatus 6 extracts the environmental information from a high-quality demodulated result of the received radio wave signals, and displays and stores the environmental information. At this time, a diversity reception method is used at the base station apparatus 6 which receives the radio wave signals transmitted by the transmitting sonobuoy and the receiving sonobuoy. Here, in the diversity reception method, the radio wave signals are received from the sonobuoys 5-1 and 5-2 to obtain a quality demodulated result. That is, in the diversity reception method, the radio wave signals are received from the sonobuoys 5-1 and 5-2. The band-pass filters and the digital circuits corresponding to each of the sonobuoys 5-1 and 5-2 select and demodulate each of the radio wave signals, and the radio wave signal having better quality demodulated result is selected and combined.

That is, by the antenna 30, the base station apparatus 6 receives the radio wave signals indicating the environmental information which the transmission sonobuoy and the reception sonobuoy transmit in Step 93 (S93) respectively. The received radio wave signals are separated by the band-pass filters 31-1 and 31-2 corresponding to the sonobuoys 5-1 and 5-2. The digital demodulator circuits 32-1 and 32-2 demodulate the radio wave signals having passed through the corresponding band-pass filters 31-1 and 31-2 and output digital bit series signals respectively. On the other hand, the radio field intensity calculation circuit 37 calculates each intensity of the radio wave signal which has passed through the respective band-pass filters 31-1 and 31-2, and outputs the intensity as quality information on each of radio wave signals corresponding to the band-pass filters 31-1 and 31-2. The selection combining circuit 33 selects each better quality demodulated result out of demodulated results outputted by the respective digital demodulator circuits 32-1 and 32-2 and combines to output digital bit series signals having good quality in total. The selection combining circuit 33 may select demodulated results of the digital demodulator circuit which demodulates the highest quality radio wave signals out of the respective digital demodulator circuits 32-1 and 32-2. Then, a information extraction display storing circuit (not illustrated) extracts the environment information, and displays and stores the extracted environment information.

As a combining method used for the selection combining circuit 33, an equivalent gain combining method, the maximum ratio combining method and the like, other than a selective combining method are available. In the equivalent gain combining method, a plurality of radio wave signals each having the same information transmitted from the sonobuoys 5-1 and 5-2 are separated by each of band-pass filter 31-1 and 31-2, and combines as combined signals. The combined signals are digitally demodulated. In the maximum ratio combining method, a plurality of radio wave signals each having the same information transmitted from the sonobuoys 5-1 and 5-2 are separated by each of band-pass filter 31-1 and 31-2, and each separated signal is multiplied by the corresponding receiving intensity level, respectively. Then, the plurality of multiplied signals are combined and the combined signals are digitally demodulated.

Further, a directivity control circuit (not illustrated) can be installed in the transducer unit 18 of the sonobuoy shown in FIG. 5. The directivity control circuit calculates the arrival direction of sound wave signals based on an intensity (for example, magnitude of a wave-receiving level) and a phase of sound wave signals received by a plurality of vibrators in the echo sounder receiver 21, and controls the directivity of the transducer unit 18 to face the arrival direction of the sound wave signals with high intensity. Thus, when receiving beacon signals and predetermined information from the underwater terminal 4, the directivity control circuit calculates the arrival direction of the sound wave signals, and controls the directivity of the transducer unit 18 to be oriented to the optimal direction based on the calculated value, for example. Thereby, communication quality of the sound wave signals between the sonobuoys 5-1 and 5-2 and the underwater terminal 4 can be improved.

A directivity control circuit (not illustrated) can be installed in the underwater terminal 4 shown in FIG. 4. The directivity control circuit, like the directivity control circuit provided in the transducer unit 18 of the sonobuoys 5-1 and 5-2, calculates the arrival direction of sound wave signals based on the intensity and the phase of the sound wave signal received by a plurality of vibrators in the echo sounder receiver 15, and orients the directivity of the echo sounder transmitter 14 and the echo sounder receiver 15 in a direction of high intensity of the sound wave signal. For example, the arrival direction of the sound wave signals received from the sonobuoys 5-1 and 5-2 is calculated, and the directivity of the echo sounder transmitter 14 and the echo sounder receiver 15 is controlled to be oriented to the most suitable direction based on the calculated value. Thereby, the communication quality of the sound wave signals between the sonobuoys 5-1 and 5-2 and the underwater terminal 4 can be improved.

Moreover, a depth switching circuit (not illustrated) can be installed in the transducer unit 18 of the sonobuoy shown in FIG. 5.

For example, the depth switch circuit changes the depth from the water surface of the transducer unit 18 of the sonobuoys 5-1 and 5-2 according to operator's directions from the base station apparatus 6.

Figure 9:
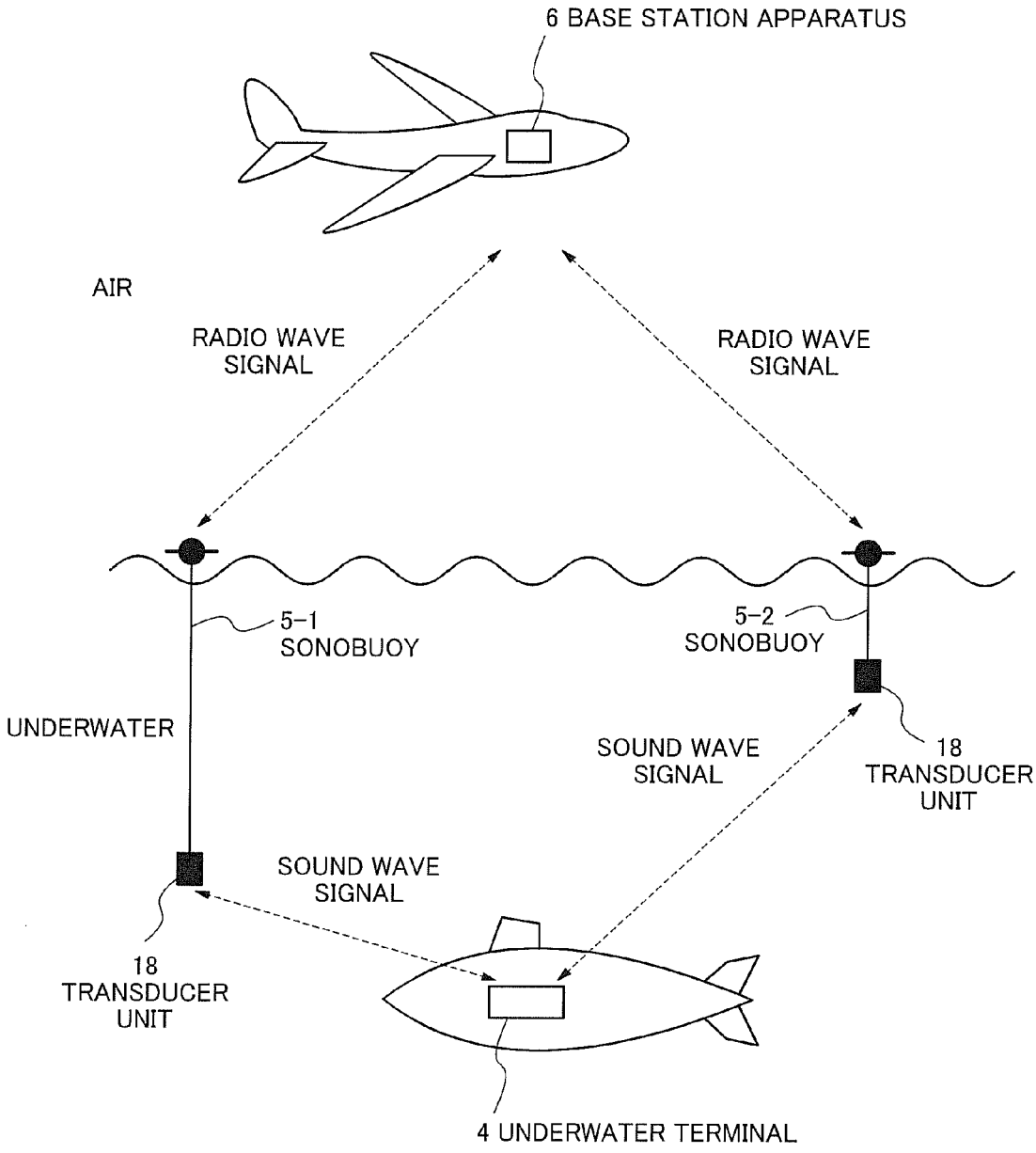
FIG. 9 is a drawing showing an example of installation of sonobuoys of the second exemplary embodiment of the communication system of the present invention shown in FIG. 3.

When the operator of the system sends the directions of depth change to a predetermined sonobuoy through the base station apparatus 6, the command generating circuit 35 of the base station apparatus 6 outputs the ID for the sonobuoy for the depth change target and control information including directions of depth change. Radio wave signals including the control information is transmitted to the sonobuoys 5-1 and 5-2 via the digital modulation circuit 36 and the antenna 30. The sonobuoys 5-1 and 5-2 receive the radio wave signals including the control information which the base station apparatus 6 transmits from the antenna 29, and demodulate the radio wave signals by the radio wave communication digital demodulator circuit 27. The control information is extracted by the command generating circuit 28. The command generating circuit 28 of the sonobuoy, whose sonobuoy ID is included in the extracted control information, outputs directions of the depth change included in the control information to the depth switching circuit of the transducer unit 18. The depth switching circuit changes the depth according to the directions of the depth change. Thus, as shown in FIG. 9, the transducer unit 18 of each of the sonobuoys 5-1 and 5-2 can be set at different depth.

Under the sea, reachable range of sound waves and reachable depth thereof strongly depend on depth of the water of thr sound source. Therefore, a shadow zone where any sound wave does not reach the echo sounder receiver 21 may be generated depending on positional relation between the echo sounder transmitter 22 and the echo sounder receiver 21. When all the echo sounder receivers of the sonobuoys 5-1 and 5-2 are located at the same depth, all the echo sounder receivers 21 of the sonobuoy 5-1 and 5-2 may be located within the shadow zone all at once. However, if the transducer unit 18 includes the depth switch circuit, the transducer unit 18 of each of the sonobuoys 5-1 and 5-2 can be set at different depth. Therefore, at least one of the sonobuoys 5-1 and 5-2 can communicate, even though the shadow zone is generated.

As described above, in the second exemplary embodiment, initially, the operator of the communication system arranges the sonobuoys 5-1 and 5-2 on the sea area where the underwater terminal 4 is likely to exist at a predetermined interval. The operator gives a starting instruction of communication with the underwater terminal 4 to the base station apparatus 6. According to such instruction of the operator of the communication system, the base station apparatus 6 and the underwater terminal 4 communicate with each other via the sonobuoy as follows. That is, in the communication system, the sonobuoys 5-1 and 5-2 receive the sound wave signals including the control signal from the underwater terminal 4. A sonobuoy which can receive the control signal from the underwater terminal 4 transmits information including the quality of the received sound wave signal to the base station apparatus 6 using the radio wave signals. The base station apparatus 6 selects the sonobuoy with the highest communication quality based on quality information on the radio wave signal received from the sonobuoy and quality information on the sound wave signal included in the radio signal, and communicates with the underwater terminal 4 via the selected sonobuoy.

In the communication system in the second exemplary embodiment, unlike the system having only one sonobuoy, it is not necessary to repeat trial-and-error operations to arrange the sonobuoy for searching an optimal sound wave communication path. In the communication system in the second exemplary embodiment, sonobuoys can be arranged in a short time. For this reason, the communication system in the second exemplary embodiment can quickly respond to emergency such as distress of a movable body in the water.

In the communication system of the second exemplary embodiment, the base station apparatus 6 may receive radio signals from the sonobuoys 5-1 and 5-2 using the diversity reception method. Therefore, the base station apparatus 6 selects and combines the radio wave signals of a high quality demodulated result in the demodulated results of the radio wave signal from the sonobuoys 5-1 and 5-2. The base station apparatus 6 may select the radio wave signal of the highest quality demodulated result in the demodulated results of the radio wave signal from the sonobuoys 5-1 and 5-2. Therefore, as compared with the communication system which has only one sonobuoy, the communication system of the second exemplary embodiment can obtain the information from the underwater terminal 4 with high stability and reliability.

In the communication system of the second exemplary embodiment, one transmitting sonobuoy transmits a command to the underwater terminal 4. Therefore, the sound wave signals in a direction to the underwater terminal 4 from the sonobuoys do not interfere with each other. In a communication system of the second exemplary embodiment, because the transmitting sonobuoy has the highest communication quality in the plurality of sonobuoys, stable communication between the base station apparatus and the underwater terminal can be performed.

In the communication system in the second exemplary embodiment, the sonobuoy which is not good as for communication quality, i.e., useless sonobuoy which does not contribute to information collecting, is specified as the communication impossible sonobuoy which is not used for communication. Therefore, in the communication system of the second exemplary embodiment, the power consumption of the total communication system is decreased and a processing load in the base station apparatus 6 is also reduced.

In a communication system disclosed by Japanese Patent Application Laid-Open No. 2003-77087 described in the background art, an underwater measuring unit 43 (i.e. underwater terminal) communicates with a signal processor 45 (i.e. base station apparatus) via one buoy unit 44 (i.e. sonobuoy).

Quality of sound wave communication between an underwater terminal and a sonobuoy is influenced by strength of ocean waves, salinity of the sea water, water temperature, and the like. The radio wave communication between a sonobuoy and a base station apparatus is wireless communication which is also influenced by an ambient environment. Therefore, quality of the communication performed between a base station apparatus and an underwater terminal via a sonobuoy fluctuates. When the fluctuation is large, either radio wave communication or sound wave communication may become impossible.

In the communication system disclosed by Japanese Patent Application Laid-Open No. 2003-77087 having only one buoy unit 44 (sonobuoy), when at least one of radio communication and sound wave communication cannot be used any more, communication between the underwater measuring unit 43 (underwater terminal) and the signal processor 45 (base station apparatus) may become disabled.

In the communication system disclosed in the document (A SIMULATION AN ACOUSTIC DATA LINK BETWEEN UNDERWATER TRANSDUCER AND MOORED BUOY, James K. Thompson and Koorosh Naghshineh, Department of Mechanical Engineering, Louisiana State University, Baton Rouge, La. 70803) described in the background art, one buoy (sonobuoy) is used in order to communicate with underwater transducers like the technology of Japanese Patent Application Laid-Open No. 2003-77087. Therefore, when fluctuation of the sound wave communication between the underwater transducers (underwater terminals) and the buoy (sonobuoy) is large, the communication between the underwater transducers (underwater terminal) and the buoy (sonobuoy) may become disabled.

Figure 10:
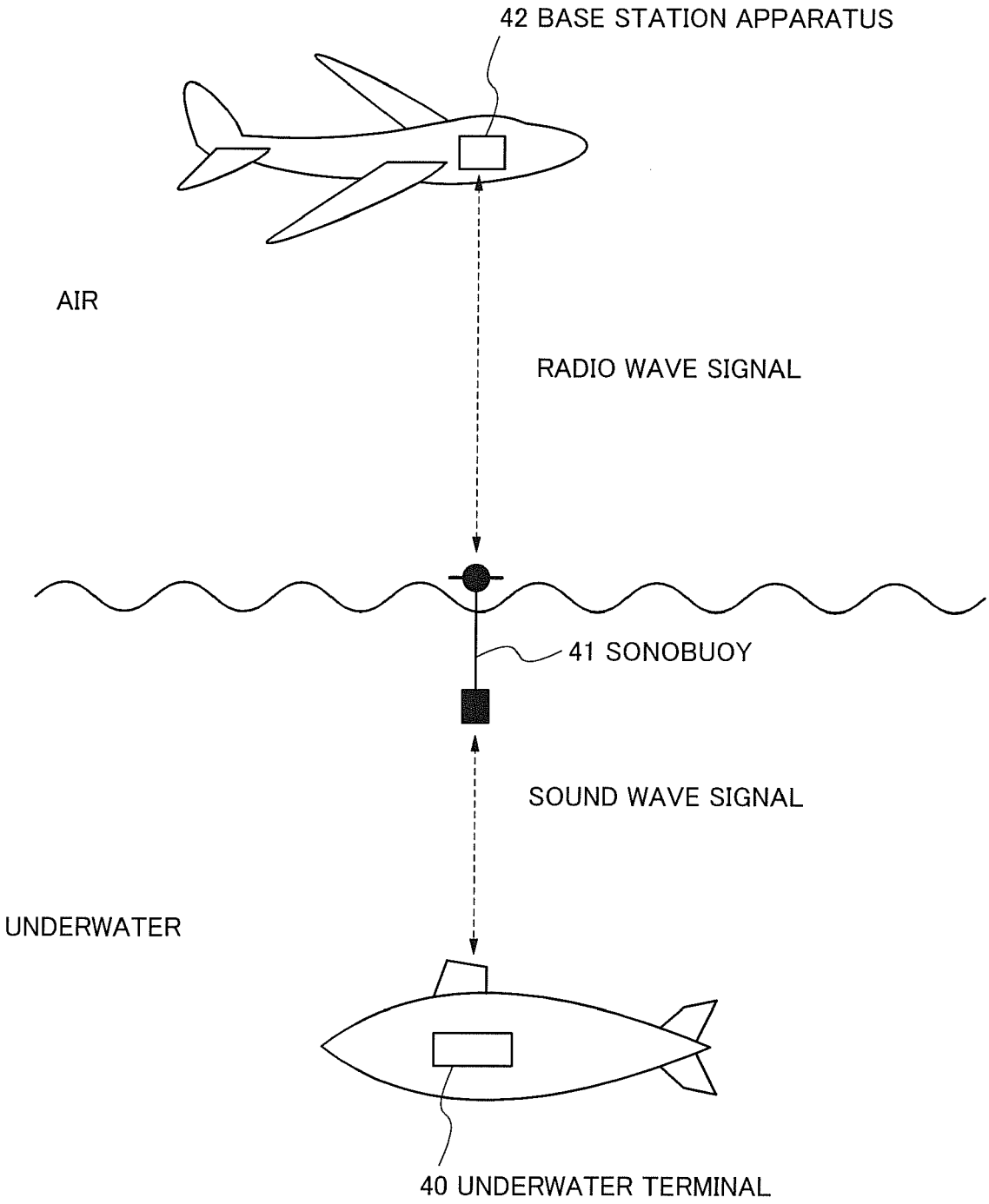
FIG. 10 is a drawing showing a communication system for relaying communication between an underwater terminal installed in an underwater movable body, and a base station apparatus installed in a flight vehicle in the air via one sonobuoy.
Figure 11:
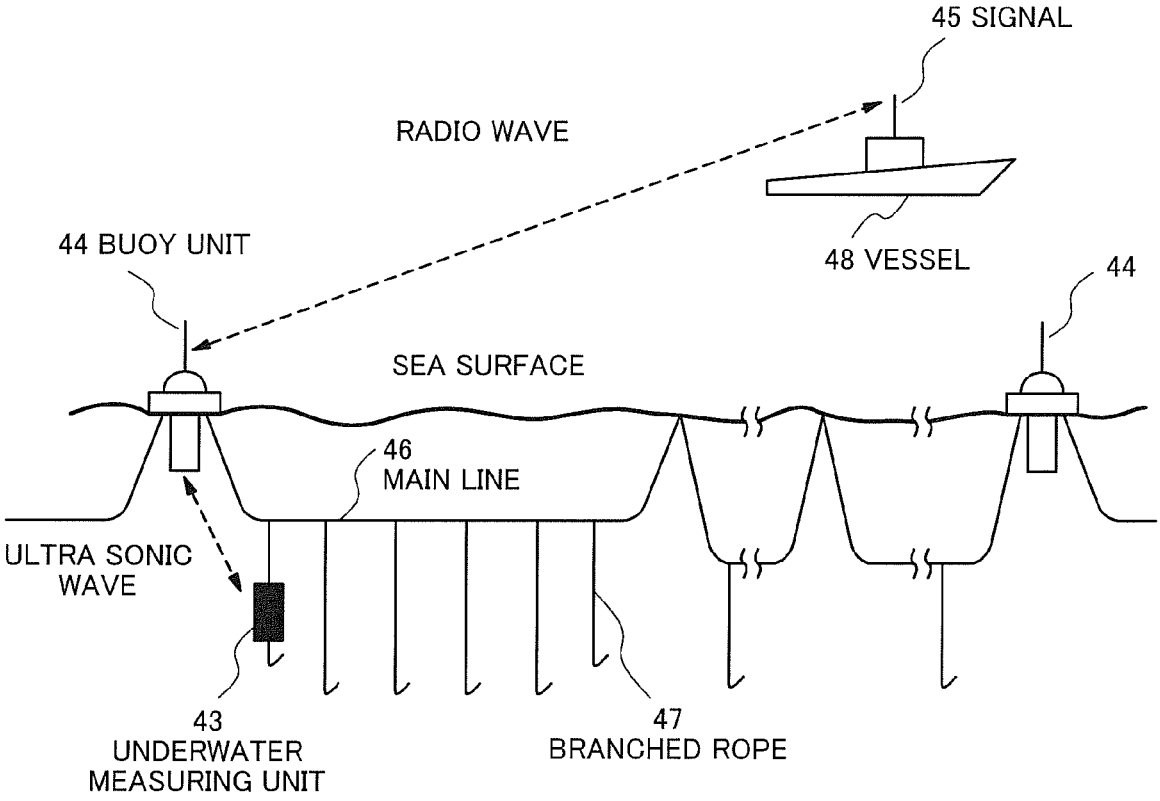
FIG. 11 is a drawing showing the communication system which receives data measured by an underwater measuring unit via a buoy unit by a signal processor installed in a marine vessel.

In the communication system shown in FIG. 10 described in the background art, the base station apparatus 42 communicates with the underwater equipment 40 via one sonobuoy. The communication system of FIG. 10 includes only one sound wave communication path between the sonobuoy 41 and underwater equipment 40. Quality of the sound wave communication fluctuates in response to influences of strength of waves, salinity of sea water, sea water temperature, etc. Thus, it is necessary to search the optimal sound wave communication path with little influence of the fluctuation of quality of the sound wave communication.

In the communication system indicated in FIG. 10, in order to search the optimal sound wave communication path, the sonobuoy 41 is repeatedly arranged and recovered, and the location thereof is changed. By such operations, the possibility of the communication with the base station apparatus 42 and the underwater apparatus 40 via the sonobuoy 41 is examined. Thus, the communication system requires much time and workload to search the optimal location of the sonobuoy.

Moreover, in the communication system shown in FIG. 10, the base station apparatus 42 communicates with the underwater equipment 40 via one sonobuoy 41. There are only one sound wave communication path between the sonobuoy 41 and the underwater equipment 40 and only one radio communication path between the sonobuoy 41 and the base station apparatus 42 respectively. The radio wave communication of the sonobuoy 41 is the wireless communication whose quality fluctuates under influence of ambient environment. Therefore, when the quality of the radio wave communication and the sound wave communication widely fluctuates, at least one of the radio wave communication and the sound wave communication cannot be used any more. Then, communication between the underwater terminal 40 and the base station apparatus 42 may become disabled.

An exemplary advantage according to the invention is in the following.

As described above, in the present invention, the operator of the communication system arranges the sonobuoys 5-1 and 5-2 at a predetermined interval on a sea area where the underwater terminal 4 is likely to exist. The operator inputs an instructions to start communication with the underwater terminal 4 into the base station apparatus 6. In response to such instruction of the operator, the base station apparatus 6 and underwater apparatus 4 communicate with each other via the sonobuoy. That is, in the communication system, the sonobuoys 5-1 and 5-2 receive the sound wave signals including the control signal from the underwater terminal 4. The sonobuoy which can receive the control signal from the underwater terminal 4 transmits information including quality of the received sound wave signal to the base station apparatus 6 using the radio wave signals. The base station apparatus 6 selects the sonobuoy having the highest communication quality based on the quality of the radio wave signal from the sonobuoys 5-1 and 5-2 and the quality information of the sound wave signal included in the radio wave, and communicates with the underwater terminal 4 via the selected sonobuoy.

Unlike the communication system having only one sonobuoy, the communication system of the present invention does not need to repeat the trial-and-error operation for arranging the sonobuoy to search an optimal sound wave communication path which hardly suffers from influences of fluctuation of quality of the sound wave communication. In the communication system of the present invention, the sonobuoy can be arranged in a short time. For this reason, the communication system of the present invention can quickly respond to emergency such as distress of a movable body in the water. Since the base station apparatus 6 selects the sonobuoy having the highest communication quality from the sonobuoys 5-1 and 5-2 and communicates with the underwater terminal via the selected sonobuoy, risks of disconnection of the communication path between the underwater terminal 4 and the base station apparatus 6 can be reduced compared with the communication system with only one sonobuoy.

While the invention has been particularly shown and described with reference to exemplary embodiments thereof, the invention is not limited to these exemplary embodiments. It will be understood by those of ordinary skill in the art that various changes in form and details may be made therein without departing from the spirit and scope of the present invention as defined by the claims.

Further, it is the inventor's intention to retain all equivalents of the claimed invention even if the claims are amended during prosecution.

What is claimed is:

1. A communication system for obtaining predetermined information from an underwater terminal via a sonobuoy, comprising:

an underwater terminal for transmitting and receiving sound wave signals;

a base station apparatus for transmitting and receiving radio wave signals; and a plurality of sonobuoys for transmitting and receiving said sound wave signals to and from said underwater terminal, and for transmitting and receiving said radio wave signals to and from said base station apparatus, wherein said base station apparatus selects one of the sonobuoys having a highest communication quality of based on both communication quality said sound wave signals and communication quality of said radio wave signals, and obtains prescribed information from said underwater terminal via the one of the sonobuoys selected, wherein said one of the sonobuoys capable of detecting said sound wave signal from said underwater terminal calculates a communication quality of said detected sound wave signal and transmits information on said communication quality of said detected sound wave signal to said base station apparatus using said radio wave signals, wherein said base station apparatus calculates said communication quality of said radio wave signal and selects said one of the sonobuoys as having the highest communication quality based on said communication quality of said sound wave signal and said calculated communication quality of said radio wave signal, and wherein said base station apparatus selects said one of the sonobuoys having said highest communication quality at least by:

receiving said radio wave signals transmitted from said plurality of sonobuoys;

selecting said radio wave signals corresponding to each of said plurality of sonobuoys;

calculating each communication quality of said radio wave signals;

demodulating said radio wave signals and extracting said each communication quality of said sound wave signals in said demodulated radio wave signals;

selecting the sonobuoy having the highest communication quality based on both said each communication quality of said sound wave signals and said each communication quality of said radio wave signals.

2. The communication system according to claim 1, wherein said any sonobuoy calculates intensity of said sound wave signal received from said underwater terminal as said communication quality of said sound wave signal, and said base station apparatus calculates intensity of said radio wave signal received from said sonobuoy as said communication quality of said radio wave signal.

3. The communication system according to claim 1, wherein said plurality of sonobuoys are arranged in a water area where said underwater terminal seems to be located at predetermined intervals.

4. The communication system according to claim 1, wherein said base station apparatus obtains the prescribed information transmitted from said underwater terminal by demodulating each of the radio wave signals transmitted from said plurality of sonobuoys, wherein said base station apparatus receives said information transmitted from said underwater terminal through each different sound wave communication path corresponding to each of said plurality of sonobuoys.

5. The communication system according to claim 1, wherein said base station apparatus includes an antenna for receiving each of said radio wave signals transmitted by said plurality of sonobuoys;

a plurality of band-pass filters corresponding to each of said plurality of sonobuoys for selecting said radio wave signals received by said antenna;

a plurality of digital demodulator circuits for respectively demodulating said radio wave signals selected by said plurality of band-pass filters; and a selection combining circuit for selecting said demodulated signal having a highest communication quality in said demodulated signals outputted from said plurality of digital demodulator circuits.

6. The communication system according to claim 1, wherein said base station apparatus includes an antenna for receiving said radio wave signals transmitted from each of said sonobuoys;

a plurality of band-pass filters corresponding to each of said sonobuoys for selecting said radio wave signals received by said antenna;

a radio-field-intensity calculation circuit for calculating said communication quality of said radio wave signals corresponding to each of said sonobuoys based on said radio wave signals selected by said plurality of band-pass filters;

a plurality of digital demodulator circuits corresponding to each of said plurality of band-pass filters for demodulating each of said radio wave signals selected by said plurality of band-pass filters and for extracting each said communication quality of said sound wave signals from said demodulated signals; and a sonobuoy selection circuit for selecting said one of the sonobuoys having the highest communication quality based on said each communication quality of said radio wave signals corresponding to said sonobuoys calculated by said radio-field-intensity calculation circuit and said each communication quality of said sound wave signals corresponding to said sonobuoys extracted by said plurality of digital demodulator circuits.

7. The communication system according to claim 6, wherein said sonobuoy selection circuit is capable of selecting the one of the sonobuoys having the highest communication quality in said sonobuoys, said one sonobuoy further having both communication quality of said radio wave signal and communication quality of said sound wave signal which are equal to or higher than a predetermined communication quality level among said plurality of sonobuoys, and specifying said one sonobuoy as a transmitting sonobuoy, wherein said base station apparatus further includes a command transmitting unit for receiving specification of said transmitting sonobuoy and transmitting said specification thereof to said plurality of sonobuoys, and wherein said specified transmitting sonobuoy in said plurality of sonobuoys transmits and receives said sound wave signals to and from said underwater terminal.

8. The communication system according to claim 7, wherein said sonobuoy selection circuit is capable of specifying said sonobuoy except for said transmitting sonobuoy as a reception sonobuoy having both communication quality of said radio wave signal and communication quality of said sound wave signal which are equal to or higher than said predetermined communication quality level, wherein said command transmitting unit is capable of receiving said specification of said reception sonobuoy and transmitting said specification thereof to said plurality of sonobuoys, and wherein said specified receiving sonobuoy only receives said sound wave signals from said underwater terminal.

9. The communication system according to claim 8, wherein said sonobuoy selection circuit is capable of specifying said sonobuoy as a communication impossible sonobuoy having both communication quality of said radio wave signal and communication quality of said sound wave signal which are lower than said predetermined communication quality level, wherein said command transmitting unit is capable of receiving said specification of said communication impossible sonobuoy and transmitting said specification thereof to said plurality of sonobuoys, and wherein said specified communication impossible sonobuoy does not communicate with said underwater terminal.

10. The communication system according to claim 1, wherein said sonobuoy includes a transducer unit for transmitting and receiving said sound wave signals to and from said underwater terminal, said transducer unit to orientate directivity of said transducer unit to an arrival direction of said sound wave signal outputted from said underwater terminal.

11. The communication system according to claim 10, wherein said underwater terminal includes an echo sounder transmitter for transmitting said sound wave signals to said sonobuoy and an echo sounder receiver for receiving said sound wave signals from said sonobuoy, and each of said echo sounder transmitter and said echo sounder receiver to orientate its own directivity to an arrival direction of said sound wave signal outputted from said sonobuoy, respectively.

12. The communication system according to claim 1, wherein said sonobuoy includes a transducer unit for transmitting and receiving said sound wave signals to and from said underwater terminal, said transducer unit to change a depth of said sonobuoy below water surface.

13. An information collecting method from an underwater terminal with a base station apparatus via a sonobuoy, the method comprising:

arranging a plurality of sonobuoys in a predetermined water area where said underwater terminal is located;

transmitting sound wave signals from said underwater terminal;

detecting said sound wave signals with said plurality of sonobuoys;

calculating a communication quality of said sound wave signal in at least one of said plurality of sonobuoys which is capable of detecting said sound wave signal;

transmitting radio wave signals including information on said communication quality of said sound wave signal to said base station apparatus;

receiving said radio wave signals and calculating communication quality of said radio wave signal in said base station apparatus;

selecting the sonobuoy having a highest communication quality in said plurality of sonobuoys based on both said communication quality of said sound wave signal and said communication quality of said radio wave signal in said base station apparatus;

obtaining a predetermined information from said underwater terminal via said sonobuoy having the highest communication quality in said base station apparatus, wherein said base station apparatus performs following steps, receiving said radio wave signals transmitted from said plurality of sonobuoys;

selecting said radio wave signals corresponding to each of said plurality of sonobuoys;

calculating each communication quality of said radio wave signals;

demodulating said radio wave signals and extracting said each communication quality of said sound wave signals in said demodulated radio wave signals;

selecting the sonobuoy having the highest communication quality based on both said each communication quality of said sound wave signals and said each communication quality of said radio wave signals.

14. A base station apparatus for obtaining predetermined information from an underwater terminal via a plurality of sonobuoys, each said sonobuoy communicating with said underwater terminal using sound wave signals and communicating with said base station apparatus using radio wave signals, wherein said base station apparatus selects one of the sonobuoys having a highest communication quality based on both communication quality of said sound wave signals and communication quality of said radio wave signals, and obtains prescribed information from said underwater terminal via the one of the sonobuoys selected, wherein said base station apparatus receives said radio wave signals including information on each communication quality of said sound wave signals which said plurality of sonobuoys receives from said underwater terminal, calculates each communication quality of said radio wave signals, and selects the sonobuoy having the highest communication quality based on said each communication quality of said sound wave signals and said each communication quality of said radio wave signals, and wherein said base station apparatus selects said one of the sonobuoys having said highest communication quality at least by:

receiving said radio wave signals transmitted from said plurality of sonobuoys;

selecting said radio wave signals corresponding to each of said plurality of sonobuoys;

calculating each communication quality of said radio wave signals;

demodulating said radio wave signals and extracting said each communication quality of said sound wave signals in said demodulated radio wave signals;

selecting the sonobuoy having the highest communication quality based on both said each communication suali of said sound wave signals and said each communication quality of said radio wave signals.

15. The base station apparatus according to claim 14, wherein said base station apparatus includes an antenna for receiving said radio wave signals transmitted from each of said sonobuoys;

a plurality of band-pass filters corresponding to each of said sonobuoys for selecting said radio wave signals received by said antenna;

a radio-field-intensity calculation circuit for calculating communication quality of said radio wave signals corresponding to each of said sonobuoys based on said radio wave signals selected by said plurality of band-pass filters convert;

a plurality of digital demodulator circuits corresponding to each of said plurality of band-pass filters for demodulating each of said radio wave signals selected by said plurality of band-pass filters and for extracting each communication quality of said sound wave signals from said demodulated signals; and a sonobuoy selection circuit for selecting the sonobuoy having the highest communication quality based on said each communication quality of said radio wave signals corresponding to said sonobuoys calculated by said radio-field-intensity calculation circuit and said each communication quality of said sound wave signals corresponding to said sonobuoys extracted by said plurality of digital demodulator circuits.

16. The base station apparatus according to claim 15, wherein said sonobuoy selection circuit is capable of selecting the sonobuoy having the highest communication quality in said sonobuoys, said sonobuoy further having both communication quality of said radio wave signal and communication quality of said sound wave signal which are equal to or higher than a predetermined communication quality level among said plurality of sonobuoys, and specifying said one sonobuoy as a transmitting sonobuoy, and wherein said base station apparatus includes a command transmitting unit for receiving said specification of said transmitting sonobuoy and transmitting said specification thereof to said plurality of sonobuoys.

17. The base station apparatus according to claim 16, wherein said sonobuoy selection circuit is capable of specifying said sonobuoy except for said transmitting sonobuoy as a reception sonobuoy having both communication quality of said radio wave signal and communication quality of said sound wave signal which are equal to or higher than said predetermined communication quality level, and wherein said command transmitting unit is capable of receiving said specification of said reception sonobuoy and transmitting said specification thereof to said plurality of sonobuoys.

18. The base station apparatus according to claim 15, wherein said sonobuoy selection circuit is capable of specifying said sonobuoy as a communication impossible sonobuoy having both communication quality of said radio wave signal and communication quality of said sound wave signal which are lower than said predetermined communication quality level, wherein said command transmitting unit is capable of receiving said specification of said communication impossible sonobuoy and transmitting said specification thereof to said plurality of sonobuoys.

19. A base station apparatus for obtaining predetermined information from an underwater terminal via a plurality of sonobuoys, each said sonobuoy communicating with said underwater terminal using sound wave signals and communicating with said base station apparatus using radio wave signals, wherein said base station apparatus performs diversity reception of said radio wave signals from two or more sonobuoys of said plurality of sonobuoys, wherein said any sonobuoy calculates a communication quality of said detected sound wave signal and transmits information on said communication quality of said detected sound wave signal to said base station apparatus using said radio wave signals, wherein said base station apparatus calculates said communication quality of said radio wave signal and selects said one of the sonobuoys having the highest communication quality based on said communication quality of said sound wave signal and said calculated communication quality of radio wave signal, and wherein said base station apparatus selects said one of the sonobuoys having said highest communication quality at least by:

receiving said radio wave signals transmitted from said plurality of sonobuoys;

selecting said radio wave signals corresponding to each of said plurality of sonobuoys;

calculating each communication quality of said radio wave signals;

demodulating said radio wave signals and extracting said each communication quality of said sound wave signals in said demodulated radio wave signals;

selecting the sonobuoy having the highest communication quality based on both said each communication quiality of said sound wave signals and said each communication quality of said radio wave signals.

20. The base station apparatus according to claim 19, wherein said base station apparatus includes an antenna for receiving each of said radio wave signals transmitted by said plurality of sonobuoys;

a plurality of band-pass filters corresponding to each of said plurality of sonobuoys for selecting said radio wave signals received by said antenna;

a plurality of digital demodulator circuits for respectively demodulating signals selected by said plurality of band-pass filters; and a selection combining circuit for selecting said demodulated signal having high communication quality in said demodulated signals outputted from said plurality of digital demodulator circuits.

* * * * *